US010685599B2

(12) United States Patent
Miyasaka et al.

(10) Patent No.: US 10,685,599 B2
(45) Date of Patent: Jun. 16, 2020

(54) ELECTRO-OPTICAL DEVICE AND ELECTRONIC APPARATUS

(71) Applicant: SEIKO EPSON CORPORATION, Tokyo (JP)

(72) Inventors: Mitsutoshi Miyasaka, Suwa (JP); Yoichi Momose, Matsumoto (JP); Kiyoshi Sekijima, Shiojiri (JP)

(73) Assignee: SEIKO EPSON CORPORATION, Tokyo (JP)

( * ) Notice: Subject to any disclaimer, the term of this patent is extended or adjusted under 35 U.S.C. 154(b) by 0 days.

(21) Appl. No.: 16/202,538

(22) Filed: Nov. 28, 2018

(65) Prior Publication Data

US 2019/0164479 A1 May 30, 2019

(30) Foreign Application Priority Data

Nov. 29, 2017 (JP) ..... 2017-228728

(51) Int. Cl.

| | |
|---|---|
| ***G09G 3/30*** | (2006.01) |
| ***G09G 3/3225*** | (2016.01) |
| *G09G 3/00* | (2006.01) |
| *G09G 3/20* | (2006.01) |

(52) U.S. Cl.

CPC ..... *G09G 3/3225* (2013.01); *G09G 3/001* (2013.01); *G09G 3/2022* (2013.01); *G09G 2300/0819* (2013.01); *G09G 2300/0842* (2013.01); *G09G 2300/0857* (2013.01); *G09G 2310/08* (2013.01); *G09G 2320/0233* (2013.01)

(58) Field of Classification Search

CPC .. G09G 3/3208; G09G 3/3225; G09G 3/3233; G09G 3/3258; G09G 2300/0842

See application file for complete search history.

(56) References Cited

U.S. PATENT DOCUMENTS

| | | | | |
|---|---|---|---|---|
| 8,866,707 | B2 | 10/2014 | Koyama et al. | |
| 2002/0018029 | A1* | 2/2002 | Koyama ..... | G09G 3/3275 345/39 |
| 2002/0070913 | A1 | 6/2002 | Kimura et al. | |
| 2002/0140642 | A1 | 10/2002 | Okamoto | |
| 2003/0142054 | A1* | 7/2003 | Tada ..... | G09G 3/3614 345/87 |

(Continued)

FOREIGN PATENT DOCUMENTS

| | | | |
|---|---|---|---|
| JP | 2002-287695 | A | 10/2002 |
| JP | 2004-62161 | A | 2/2004 |

(Continued)

*Primary Examiner* — Roy P Rabindranath
(74) *Attorney, Agent, or Firm* — Oliff PLC

(57) ABSTRACT

An electro-optical device includes a pixel circuit provided to correspond to an intersection of a scan line and a data line, a low potential line, and a high potential line. The pixel circuit includes a light emitting element, a first transistor, and a memory circuit including a first inverter, a second inverter, and a second transistor. The first transistor is disposed between an first input terminal of the first inverter and the data line. The second transistor is disposed between an second output terminal of the second inverter and the first input terminal. An first output terminal of the first inverter is electrically connected to an second input terminal of the second inverter. When the first transistor is in an ON-state, the second transistor is in an OFF-state.

13 Claims, 11 Drawing Sheets

(56) References Cited

U.S. PATENT DOCUMENTS

| | | | | |
|---|---|---|---|---|
| 2004/0047530 | A1 | 3/2004 | Hara et al. | |
| 2006/0221033 | A1* | 10/2006 | Yasuda ..... | G09G 3/3648 345/92 |
| 2006/0274090 | A1 | 12/2006 | Koyama et al. | |
| 2012/0105496 | A1 | 5/2012 | Komiya | |
| 2012/0127221 | A1 | 5/2012 | Tamaki et al. | |

FOREIGN PATENT DOCUMENTS

| | | | |
|---|---|---|---|
| JP | 2004-62163 | A | 2/2004 |
| JP | 2004-62199 | A | 2/2004 |
| JP | 2004-163601 | A | 6/2004 |
| JP | 2006-309182 | A | 11/2006 |
| JP | 2010-217661 | A | 9/2010 |
| JP | 2012-093688 | A | 5/2012 |
| JP | 2012-128407 | A | 7/2012 |

* cited by examiner

ELECTRO-OPTICAL DEVICE AND ELECTRONIC APPARATUS

BACKGROUND

1. Technical Field

The present invention relates to an electro-optical device and an electronic apparatus.

2. Related Art

In recent years, head-mounted displays (HMDs) have been proposed that are a type of electronic apparatus that enables formation and viewing of a virtual image by directing image light from an electro-optical device to the pupil of an observer. One example of the electro-optic device used in these electronic devices is an organic electro-luminescence (EL) device that includes an organic EL element as a light-emitting element. The organic EL devices used in head-mounted displays are required to provide high resolution (fine pixels), multiple gray scales of display, and low power consumption.

In known organic EL devices, when a selecting transistor is placed into an ON-state by a scan signal supplied to a scan line, an electrical potential based on an image signal supplied from a data line is maintained in a capacitive element connected to the gate of a drive transistor. When the drive transistor is placed into the ON-state according to the potential maintained in the capacitive element, namely, the gate potential of the drive transistor, a current in amount according to the gate potential of the drive transistor flows to the organic EL element, and the organic EL element emits light at an intensity according to the current amount.

In this way, the grey-scale display is performed by analog driving that controls the current flowing through the organic EL element according to the gate potential of the drive transistor in a typical organic EL device. Thus, variations in current-voltage characteristics and a threshold voltage of the drive transistor cause variations in brightness and shifts in grey-scale between pixels. As a result, display quality may decrease. In contrast, an organic EL device including a compensating circuit that compensates for variations in current-voltage characteristics and a threshold voltage of a drive transistor has been conceivable (for example, see JP-A-2004-062199).

However, when a compensating circuit is provided as described in JP-A-2004-062199, a current also flows through the compensating circuit, which may cause an increase in power consumption. For typical analog driving, the electric capacitance of a capacitive element that stores an image signal needs to be increased in order to achieve more grey-scales of display. This requirement is a trade-off with high resolution (fine pixels) and may result in an increased power consumption due to charging and discharging of the capacitive element. In other words, in the typical technology, an electro-optical device capable of displaying a high-resolution, multi-grey-scale, and high-quality image at low power consumption may be difficult to achieve.

SUMMARY

The present invention is made to address at least some of the above-described issues, and can be realized as the following aspects or application examples.

Application Example 1

An electro-optical device according to the present application example includes a scan line, a data line, a pixel circuit provided at an intersection of the scan line and the data line, a first potential line supplied with a first potential, and a second potential line supplied with a second potential different from the first potential. The pixel circuit includes a light emitting element, a first transistor, and a memory circuit including a first inverter, a second inverter and a second transistor. The memory circuit is disposed between the first potential line and the second potential line. The first transistor is disposed between an input of the first inverter and the data line. The second transistor is disposed between an output of the second inverter and the input of the first inverter. An output of the first inverter is electrically connected to an input of the second inverter. When the first transistor is in an ON-state, the second transistor is in an OFF-state.

According to the configuration of the present application example, the memory circuit including the first inverter and the second inverter is disposed between the first potential line and the second potential line, and the first transistor is disposed between the input of the first inverter and the data line in the pixel circuit. Thus, grey-scale display can be performed by writing a digital image signal expressed by binary values of ON and OFF from the data line to the memory circuit through the first transistor and controlling the ratio of emission to non-emission of the light emitting element with the image signal output from the memory circuit. In this way, the influence of variation in the current-voltage characteristics and the threshold voltage of each transistor can be minimized and the variation in brightness and shifts in grey-scale between pixels can be reduced without a compensating circuit. In the digital driving, the number of gradations can be easily increased without a capacitive element by increasing the number of subfields that serve as units for controlling emission and non-emission of the light emitting element in a field displaying a single image. Further, a capacitive element having a large electric capacity is not necessary, such that finer pixels can be achieved. In this way, finer pixels and a higher resolution can be achieved and power consumption due to charging and discharging of the capacitive element can also be reduced.

When the image signal is written (or rewritten) to the first inverter and the second inverter with the first transistor in the ON-state, the second transistor in the OFF-state interrupts the electrical connection between the output of the second inverter and the input of the first inverter, such that the image signal can be written (or rewritten) to the memory circuit in a quick and reliable manner. Furthermore, the image signal is written from the data line to the first inverter and then from the first inverter to the second inverter. This can eliminate a complementary data line and a complementary transistor as compared to a case where a complementary image signal is written from a complementary data line to a second inverter simultaneously with writing of an image signal from a data line to a first inverter. Accordingly, finer pixels and thus, a higher resolution can be easily achieved, and manufacturing yield can be improved without a need to increase the number of wires. As a result, the electro-optical device capable of displaying a high-resolution, multi-grey-scale, and high-quality image at low power consumption can be achieved at a low cost.

Application Example 2

In the electro-optical device according to the present application example, the first transistor and the second transistor may operate in a complementary manner to each other.

According to the configuration of the present application example, the second transistor is in the OFF-state when the first transistor is in the ON-state, and the second transistor is in the ON-state when the first transistor is in the OFF-state. Therefore, after the image signal is written (or rewritten) to the first inverter and the second inverter with the first transistor in the ON-state (that is, with the second transistor in the OFF-state), the image signal can be maintained by performing a static storage operation between the first inverter and the second inverter with the second transistor in the ON-state (that is, with the first transistor in the OFF-state). In this way, the image signal can be written (or rewritten) to the memory circuit in a quick and reliable manner, and the written image signal can also be maintained reliably.

Application Example 3

In the electro-optical device according to the present application example, the first transistor may be a first conductive type, and the second transistor may be a second conductive type different from the first conductive type, and a gate of the first transistor and a gate of the second transistor may be electrically connected to the scan line.

According to the configuration of the present application example, when the first transistor is the N-type, the second transistor is the P-type. Thus, the first transistor is placed into the ON-state and the second transistor is placed into the OFF-state when a High signal is supplied from the scan line. Then, when a Low signal is supplied from the scan line, the first transistor is placed into the OFF-state and the second transistor is placed into the ON-state. On the other hand, when the first transistor is the P-type, the second transistor is the N-type. Thus, the first transistor is placed into the ON-state and the second transistor is placed into the OFF-state when a Low signal is supplied from the scan line. Then, when a High signal is supplied from the scan line, the first transistor is placed into the OFF-state and the second transistor is placed into the ON-state. Therefore, the first transistor and the second transistor can operate in a complementary manner to each other by supplying the same scan signal from the scan line.

Application Example 4

In the electro-optical device according to the present application example, the light emitting element may be disposed between the output of the second inverter and the second potential line.

According to the configuration of the present application example, the light emitting element is disposed between the second potential line and the output of the second inverter. Thus, electrical connection between the light emitting element and the input of the second inverter is interrupted. When the second transistor disposed between the output of the second inverter and the input of the first inverter is in the OFF-state, electrical connection between the light emitting element and the input of the first inverter is also interrupted. Thus, even in a case where the light emitting element emits light while the image signal is written (or rewritten) to the memory circuit with the first transistor in the ON-state (with the second transistor in the ON-state), the input of the first inverter and the input of the second inverter are not affected (even in a case where a current flows through the light emitting element). Therefore, the image signal can be written (or rewritten) to the memory circuit in a quick and reliable manner.

Application Example 5

In the electro-optical device according to the present application example, the second inverter may include a third transistor, and a source of the third transistor may be electrically connected to the first potential line, and a drain of the third transistor may be electrically connected to a first terminal of the light emitting element.

According to the configuration of the present application example, the source of the third transistor is electrically connected to the first potential line, and the drain of the third transistor is electrically connected to the first terminal of the light emitting element. Thus, the light emitting element and the third transistor are disposed in series between the first potential line and the second potential line. Accordingly, the light emitting element does not emit light when the third transistor is in the OFF-state and emits light when the third transistor is in the ON-state. Therefore, the third transistor constituting the second inverter can also function as a drive transistor of the light emitting element.

Application Example 6

In the electro-optical device according to the present application example, the pixel circuit may further include a fourth transistor, and the fourth transistor may be disposed in series with the light emitting element between the output of the second inverter and the second potential line.

According to the present application example, the fourth transistor is disposed in series with the light emitting element between the output of the second inverter and the second potential line. In other words, the fourth transistor is disposed in series with the light emitting element and the third transistor between the first potential line and the second potential line. As a result, the light emitting element does not emit light when the fourth transistor is in the OFF-state and emits light when the third transistor is placed into the ON-state with the fourth transistor in the ON-state. In other words, the first transistor can be placed into the ON-state with the fourth transistor in the OFF-state, allowing the light emitting element to be placed in the non-emission state over a period during which the image signal is written to the memory circuit. Furthermore, the period during which the fourth transistor is placed in the ON-state and the period during which the fourth transistor is placed in the OFF-state can be freely controlled during a period in which an image signal is maintained with the first transistor in the OFF-state (with the second transistor in the ON-state). Thus, after the image signal has been written to the memory circuit, the light emitting element can be allowed to emit light over a certain period of time as a display period. In this way, a more accurate grey-scale display can be achieved by time division driving.

Application Example 7

An electronic apparatus according to the present application example includes the electro-optical device described in the above-described application example.

According to the configuration of the present application example, high quality of an image displayed in the electronic apparatus such as a head-mounted display can be achieved.

BRIEF DESCRIPTION OF THE DRAWINGS

The invention will be described with reference to the accompanying drawings, wherein like numbers reference like elements.

DESCRIPTION OF EXEMPLARY EMBODIMENTS

Hereinafter, exemplary embodiments of the invention will be described with reference to drawings. Note that, in each of the drawings below, to make each layer, member, and the like recognizable in terms of size, each of the layers, members, and the like are not to scale.

Outline of Electronic Apparatus

Figure 1:
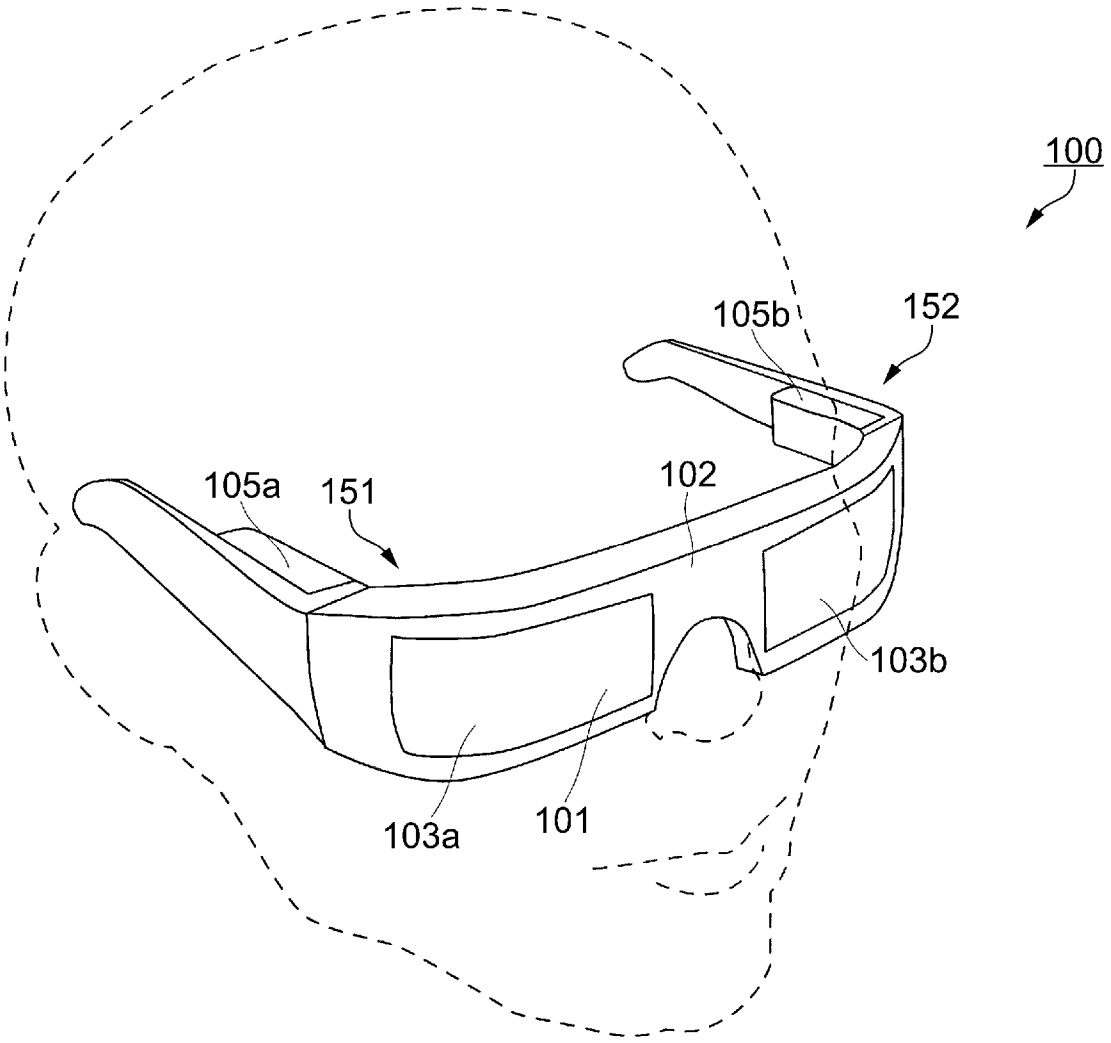
FIG. 1 shows a diagram illustrating overview of an electronic apparatus according to the present exemplary embodiment.

First, an outline of an electronic apparatus will be described with reference to FIG. 1. FIG. 1 shows a diagram illustrating overview of the electronic apparatus according to the present exemplary embodiment.

Figure 3:
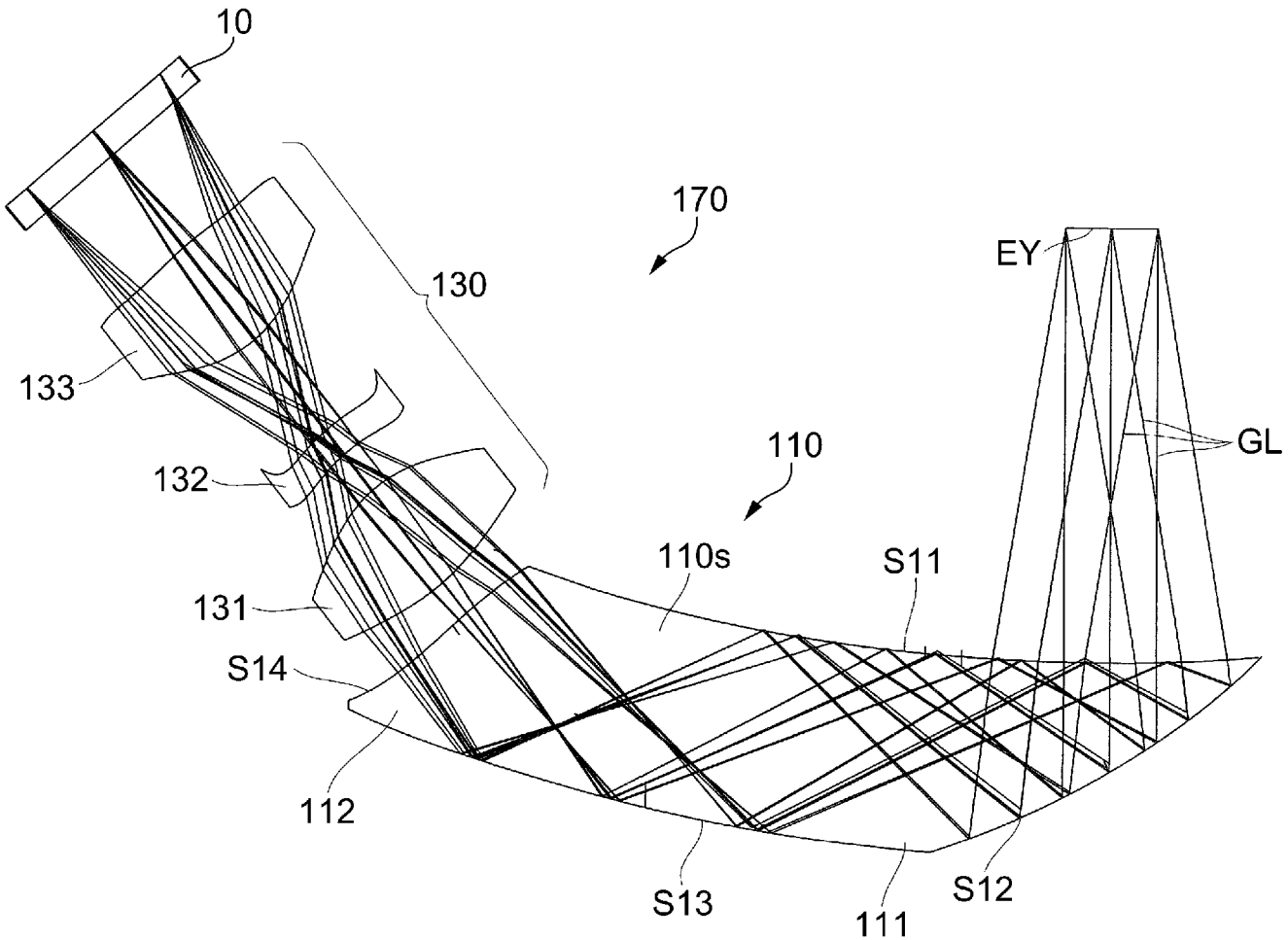
FIG. 3 shows a diagram illustrating an optical system of the electronic apparatus according to the present exemplary embodiment.

A head-mounted display 100 is one example of the electronic apparatus according to the present exemplary embodiment, and includes an electro-optical device 10 (see FIG. 3). As illustrated in FIG. 1, the head-mounted display 100 has an external appearance similar to a pair of glasses. The head-mounted display 100 allows a user who wears the head-mounted display 100 to view image light GL of an image (refer to FIG. 3) and allows the user to view extraneous light as a see-through image. In other words, the head-mounted display 100 has a see-through function of superimposing the extraneous light over the image light GL to display an image, and has a small size and weight while having a wide angle of view and high performance.

The head-mounted display 100 includes a see-through member 101 that covers the front of eyes of the user, a frame 102 that supports the see-through member 101, and a first built-in device unit 105*a* and a second built-in device unit 105*b* attached to respective portions of the frame 102 extending from cover portions at both left and right ends of the frame 102 over rear sidepieces (temples).

The see-through member 101 is a thick, curved optical member (transparent eye cover) that covers the front of the eyes of the user and is separated into a first optical portion 103*a* and a second optical portion 103*b*. A first display apparatus 151 shown on the left side of FIG. 1 that combines the first optical portion 103*a* and the first built-in device unit 105*a* is a portion that displays a see-through virtual image for the right eye and can alone serves as an electronic apparatus having a display function. A second display apparatus 152 shown on the right side of FIG. 1 that combines the second optical portion 103*b* and the second built-in device unit 105*b* is a portion that forms a see-through virtual image for the left eye and can alone serve as an electronic apparatus having a display function. The electro-optical device 10 (see FIG. 3) is incorporated in each of the first display apparatus 151 and the second display apparatus 152.

Internal Structure of Electronic Apparatus

Figure 2:
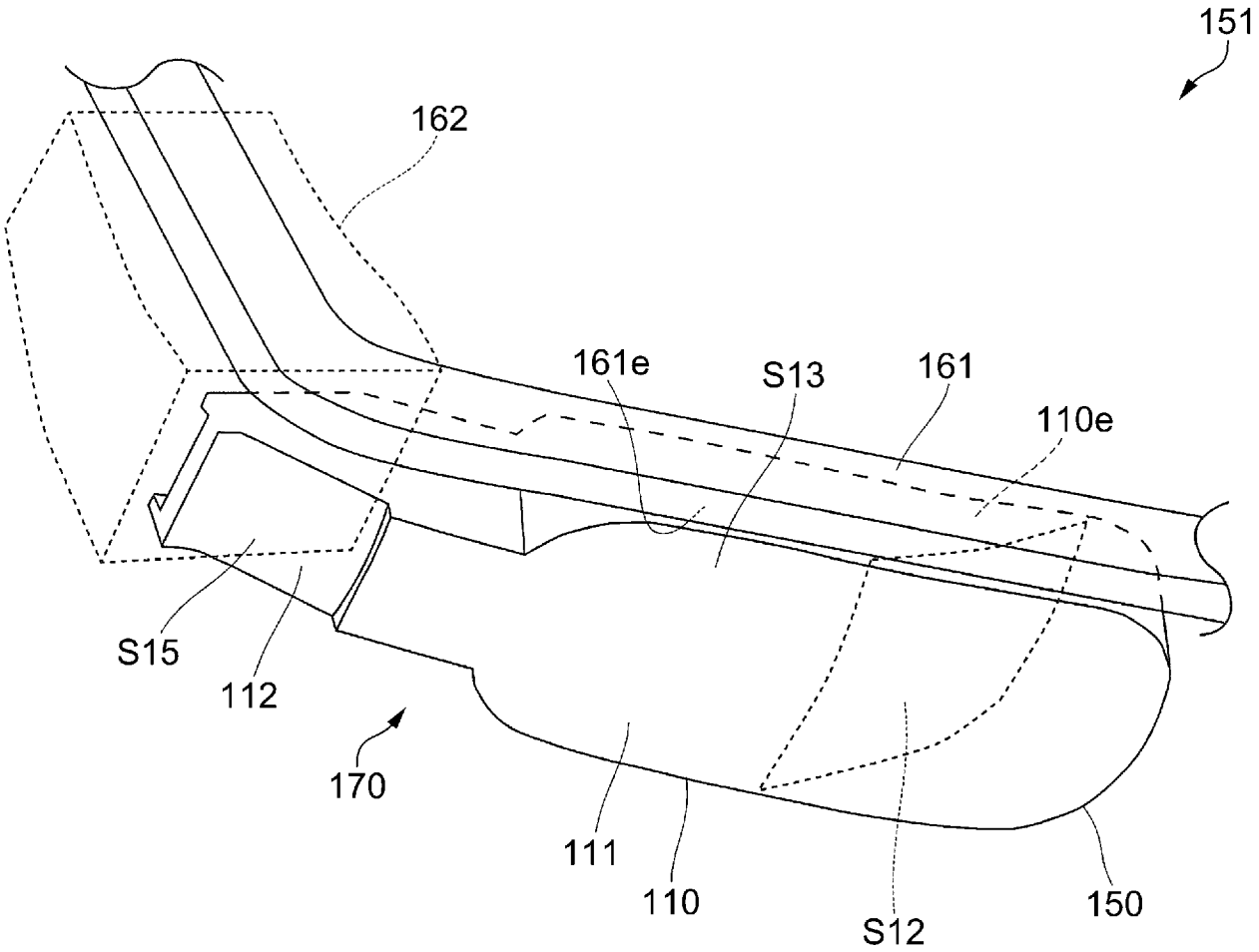
FIG. 2 shows a diagram illustrating an internal structure of the electronic apparatus according to the present exemplary embodiment.

FIG. 2 is a diagram illustrating the internal structure of the electronic apparatus according to a present exemplary embodiment. FIG. 3 is a diagram illustrating an optical system of the electronic apparatus according to the present exemplary embodiment. Next, the internal structure and the optical system of the electronic apparatus will be described with reference to FIGS. 2 and 3. While FIG. 2 and FIG. 3 illustrate the first display apparatus 151 as an example of the electronic apparatus, the second display apparatus 152 is symmetrical to the first display apparatus 151 and has substantially the same structure. Accordingly, only the first display apparatus 151 will be described here and detailed description of the second display apparatus 152 will be omitted.

As illustrated in FIG. 2, the first display apparatus 151 includes a see-through projection device 170 and the electro-optical device 10 (see FIG. 3). The see-through projection device 170 includes a prism 110 to serve as a light-guiding member, a transparent member 150, and a projection lens 130 for image formation (see FIG. 3). The prism 110 and the transparent member 150 are integrated together by bonding and are securely fixed on a lower side of a frame 161 such that an upper surface 110*e* of the prism 110 contacts a lower surface 161*e* of the frame 161, for example.

The projection lens 130 is fixed to an end portion of the prism 110 through a lens tube 162 that houses the projection lens 130. The prism 110 and the transparent member 150 of the see-through projection device 170 correspond to the first optical portion 103*a* in FIG. 1. The projection lens 130 of the see-through projection device 170 and the electro-optical device 10 correspond to the first built-in device unit 105*a* in FIG. 1.

The prism 110 of the see-through projection device 170 is an arc-shaped member curved along the face in a plan view and may be considered to be separated into a first prism portion 111 on a central side close to the nose and a second prism portion 112 on a peripheral side away from the nose. The first prism portion 111 is disposed on a light emission side and includes a first surface S11 (see FIG. 3), a second surface S12, and a third surface S13 as side surfaces having an optical function.

The second prism portion 112 is disposed on a light incident side and includes a fourth surface S14 (see FIG. 3) and a fifth surface S15 as side surfaces having an optical function. Of these surfaces, the first surface S11 is adjacent to the fourth surface S14, the third surface S13 is adjacent to the fifth surface S15, and the second surface S12 is disposed between the first surface S11 and the third surface S13. Further, the prism 110 includes the upper surface 110*e* adjacent to the first surface S11 and the fourth surface S14.

The prism 110 is made of a resin material having high optical transparency in a visible range and is molded by, for example, pouring a thermoplastic resin in a mold, and solidifying the thermoplastic resin. While a main portion 110*s* (see FIG. 3) of the prism 100 is shown as an integrally formed member, it can be considered to be separated into the first prism portion 111 and the second prism portion 112. The first prism portion 111 can guide and emit the image light GL while also allowing for see-through of the extraneous light. The second prism portion 112 can receive and guide the image light GL.

The transparent member 150 is fixed integrally with the prism 110. The transparent member 150 is a member (auxiliary prism) that assists a see-through function of the prism 110. The transparent member 150 has high optical transparency in a visible range and is made of a resin material having substantially the same refractive index as the refractive index of the main portion 110*s* of the prism 110. The transparent member 150 is formed by, for example, molding a thermoplastic resin.

As illustrated in FIG. 3, the projection lens 130 includes, for example, three lenses 131, 132, and 133 along an incident side-optical axis. Each of the lenses 131, 132, and 133 is rotationally symmetric about a central axis of a light incident surface of the lens. At least one or more of the lenses 131, 132, and 133 is an aspheric lens.

The projection lens 130 allows the image light GL emitted from the electro-optical device 10 to enter the prism 110 and refocus the image on an eye EY. In other words, the projection lens 130 is a relay optical system for refocusing the image light GL emitted from each pixel of the electro-optical device 10 on the eye EY via the prism 110. The projection lens 130 is held inside the lens tube 162. The electro-optical device 10 is fixed to one end of the lens tube 162. The second prism portion 112 of the prism 110 is connected to the lens tube 162 holding the projection lens 130 and indirectly supports the projection lens 130 and the electro-optical device 10.

An electronic apparatus that is mounted on a head of the user and covers the front of the eyes, such as the head-mounted display 100, needs to be small and light. Further, the electro-optical device 10 used in an electronic apparatus such as the head-mounted display 100 needs to have a higher resolution (finer pixels), more gradations of display, and lower power consumption.

Configuration of Electro-Optical Device

Figure 4:
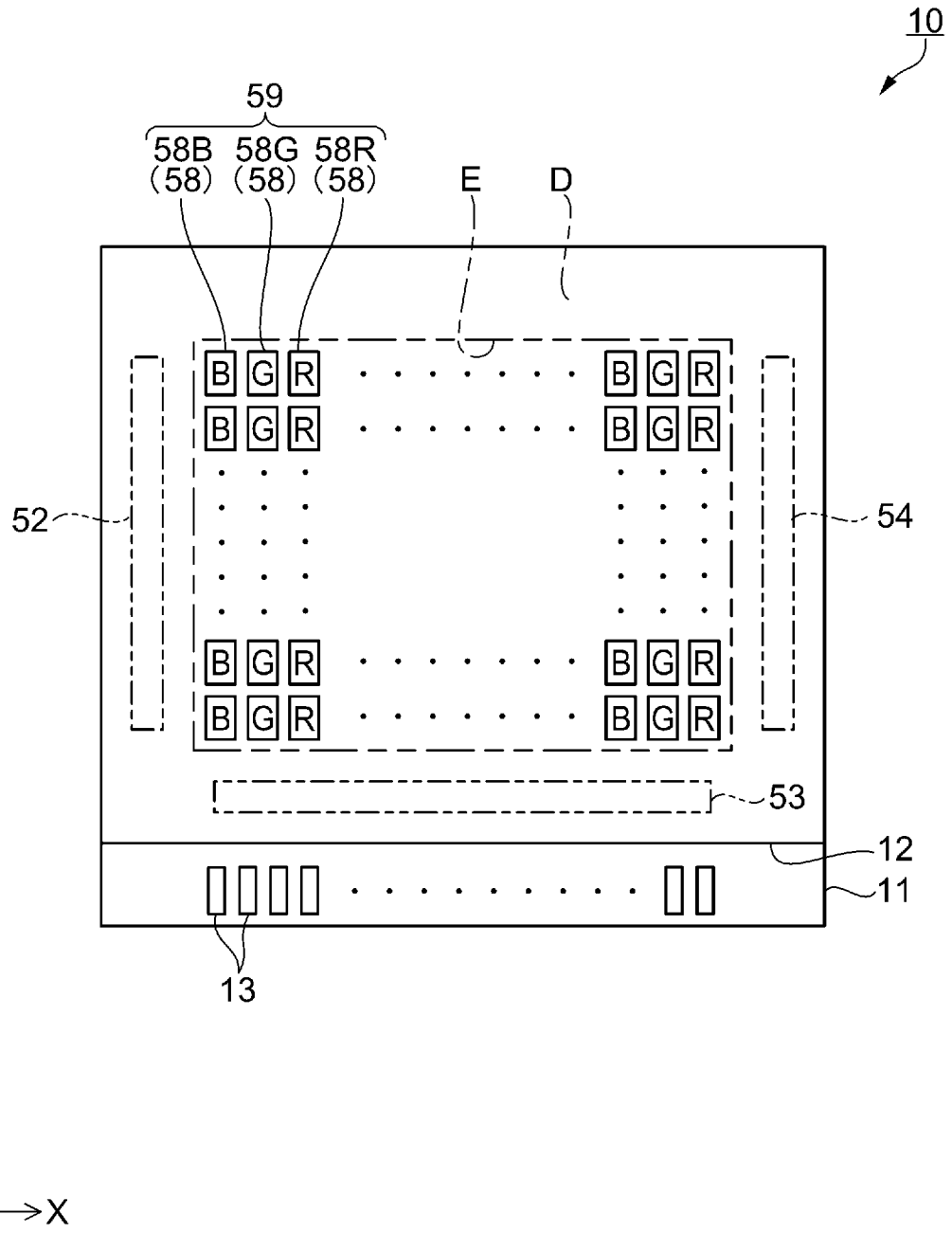
FIG. 4 shows a schematic plan view illustrating a configuration of an electro-optical device according to the present exemplary embodiment.

Next, a configuration of an electro-optical device will be described with reference to FIG. 4. FIG. 4 is a schematic plan view illustrating the configuration of the electro-optical device according to the present exemplary embodiment. The present exemplary embodiment will be described by taking, as an example, a case where the electro-optical device 10 is an organic EL device including an organic EL element as a light emitting element. As illustrated in FIG. 4, the electro-optical device 10 according to the present exemplary embodiment includes an element substrate 11 and a protective substrate 12. The element substrate 11 is provided with a color filter, which is not illustrated. The element substrate 11 and the protective substrate 12 are disposed to face each other and bonded together with a filling agent, which is not illustrated.

The element substrate 11 is formed of, for example, a single-crystal semiconductor substrate (such as a single-crystal silicon wafer). The element substrate 11 includes a display region E and a non-display region D surrounding the display region E. In the display region E, for example, a sub-pixel 58B that emits blue (B) light, a sub-pixel 58G that emits green (G) light, and a sub-pixel 58R that emits red (R) light are arranged in, for example, a matrix. Each of the sub-pixel 58B, the sub-pixel 58G, and the sub-pixel 58R is provided with a light emitting element 20 (see FIG. 6). In the electro-optical device 10, a pixel 59 including the sub-pixel 58B, the sub-pixel 58G, and the sub-pixel 58R serves as a display unit to provide a full color display.

In this specification, the sub-pixel 58B, the sub-pixel 58G, and the sub-pixel 58R may not be distinguished from one another and may be collectively referred to as a sub-pixel 58. The display region E is a region through which light emitted from the sub-pixel 58 passes and that contributes to display. The non-display region D is a region through which light emitted from the sub-pixel 58 does not pass and that does not contribute to display.

The element substrate 11 is larger than the protective substrate 12 and a plurality of external connection terminals 13 are aligned along a first side of the element substrate 11 extending from the protective substrate 12. A data line drive circuit 53 is provided between the plurality of external connection terminals 13 and the display region E. A scan line drive circuit 52 is provided between another second side orthogonal to the first side and the display region E. An enable line drive circuit 54 is provided between a third side that is orthogonal to the first side and opposite from the second side and the display region E.

The protective substrate 12 is smaller than the element substrate 11 and is disposed so as to expose the external connection terminals 13. The protective substrate 12 is a transparent substrate, and, for example, a quartz substrate, a glass substrate, and the like may be used as the protective substrate 12. The protective substrate 12 serves to protect the light emitting element 20 disposed in the sub-pixel 58 in the display region E from damage and is disposed to face at least the display region E.

Note that, a color filter may be provided on the light emitting element 20 in the element substrate 11 or provided on the protective substrate 12. When beams of light corresponding to colors are emitted from the light emitting element 20, a color filter is not essential. The protective substrate 12 is also not essential, and a protective layer that protects the light emitting element 20 may be provided instead of the protective substrate 12 on the element substrate 11.

In this specification, a direction along the first side on which the external connection terminals 13 are arranged is referred to as X direction (row direction), and a direction along the other two sides (the second side and the third side) perpendicular to the first side and opposite to each other is referred to as Y direction (column direction). For example, present exemplary embodiment adopts a so-called a stripe arrangement in which the sub-pixels 58 that emit the same color are arranged in the column direction (the Y direction) and the sub-pixels 58 that emit different colors are arranged in the row direction (the X direction).

Note that, the arrangement of the sub-pixels 58 in the row direction (X direction) may not be limited to the order of B, G, and R as illustrated in FIG. 4 and may be in the order of, for example, R, G, and B. The arrangement of the sub-pixels 58 is not limited to the stripe arrangement and may be a delta arrangement, a Bayer arrangement or an S-stripe arrangement. In addition, the sub-pixels 58B, the sub-pixels 58G and the sub-pixels 58R are not limited to the same shape or size.

Configuration of Circuit of Electro-Optical Device

Figure 5:
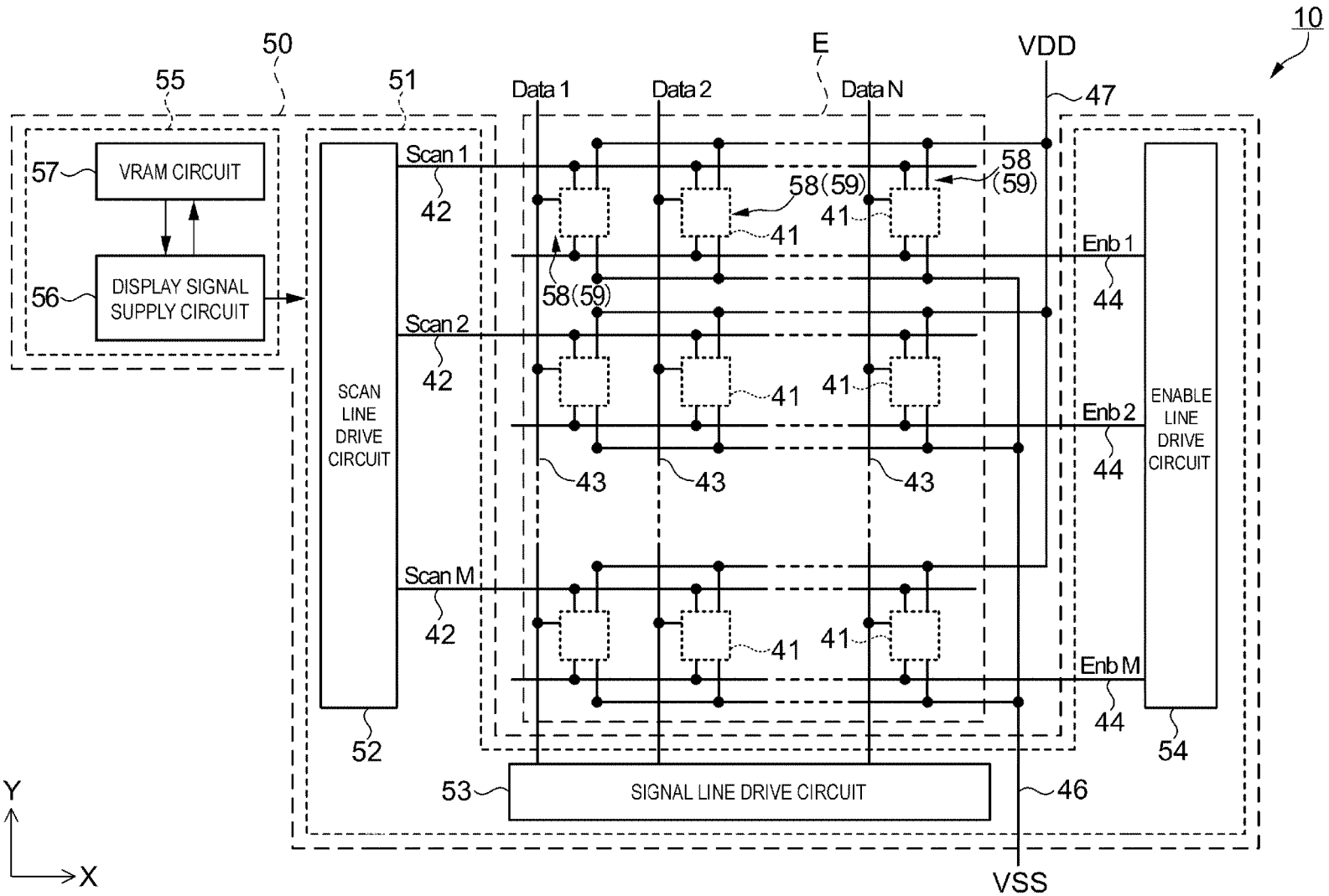
FIG. 5 shows a block diagram of a circuit of the electro-optical device according to the present exemplary embodiment.

Next, a configuration of the circuit of the electro-optical device will be described with reference to FIG. 5. FIG. 5 shows a block diagram of the circuit of the electro-optical device according to the present exemplary embodiment. As illustrated in FIG. 5, formed in the display region E of the electro-optic device 10 are a plurality of scan lines 42 and a plurality of data lines 43 that cross each other with the sub-pixels 58 being arranged in a matrix to correspond to the respective intersections of the scan lines 42 and the data lines 43. Each of the sub-pixels 58 includes a pixel circuit 41 including the light emitting element 20 (see FIG. 8) and the like.

An enable line 44 is formed for each of the corresponding scan lines 42 in the display region E. The scan line 42 and the enable line 44 extend in the row direction (X direction). The data line 43 extends in the column direction (Y direction).

In the electro-optical device 10, the sub-pixels 58 in M rows×N columns are arranged in a matrix in the display region E. Specifically, M scan lines 42, M enable lines 44, and N data lines 43 are formed in the display region E. Note that, M and N are integers of two or more, and M=720 and N=1280×p as one example in the present exemplary embodiment. p is an integer of one or more and indicates the number of basic display colors. The present exemplary embodiment is described by taking, as an example, a case where p=3, that is, the basic display colors are three colors of R, G, and B.

The electro-optical device 10 includes a drive unit 50 outside the display region E. The driving unit 50 supplies various signals to the respective pixel circuits 41 arranged in the display region E, such that an image in which the pixels 59 (with sub-pixels 58 for three colors) serve as units of display is displayed in the display region E. The drive unit 50 includes a drive circuit 51 and a control unit 55. The control unit 55 supplies a display signal to the drive circuit 51. The drive circuit 51 supplies a drive signal to each of the pixel circuits 41 through the plurality of scan lines 42, the plurality of data lines 43, and the plurality of enable lines 44, based on the display signal.

The drive circuit 51 includes the scan line drive circuit 52, the data line drive circuit 53, and the enable line drive circuit 54. The drive circuit 51 is provided in the non-display region D (see FIG. 4). In the present exemplary embodiment, the drive circuit 51 and the pixel circuit 41 are formed on the element substrate 11 (single-crystal silicon wafer in the present exemplary embodiment) illustrated in FIG. 4. Specifically, the drive circuit 51 and the pixel circuit 41 are each formed of an element such as a transistor formed on the single-crystal silicon wafer.

The scan lines 42 are electrically connected to the scan line drive circuit 52. The scan line drive circuit 52 outputs a scan signal (Scan) that allows the pixel circuits 41 to be selected or unselected in the row direction to respective scan lines 42, and the scan lines 42 transmit the scan signals to the pixel circuits 41. In other words, the scan signal has a selection state (selection signal) and a non-selection state (non-selection signal), and the scan line 42 is appropriately selected by receiving the scan signal from the scan line drive circuit 52.

Furthermore, a low potential line 46 as a first potential line and a high potential line 47 as a second potential line are arranged in the non-display region D and the display region E. The low potential line 46 supplies a first potential (V1) to each of the pixel circuits 41, and the high potential line 47 supplies a second potential (V2) different from the first potential to each of the pixel circuits 41. In the present exemplary embodiment, the first potential (V1) is a low potential VSS (V1=VSS=2.0 V as one example), and the second potential (V2) is a high potential VDD (V2=VDD=7.0 V as one example).

While the low potential line 46 and the high potential line 47 extend in the row direction within the display region E as one example in the present exemplary embodiment, they may extend in the column direction, some of them may extend in the row direction while the others extend in the column direction, or they may be arranged in a grid pattern in the row and column directions.

Note that, to specify a scan signal supplied to a scan line 42 in an i-th row of the M scan lines 42, the scan signal is designated as a scan signal Scan i in the i-th row. The scan line drive circuit 52 includes a shift register circuit, which is not illustrated, and a signal for shifting the shift register circuit is output as a shift output signal for each stage. The shift output signals are then used to generate scan signals from Scan 1 in a first row to Scan M in an M-th row.

The data line 43 is electrically connected to the data line drive circuit 53. The data line drive circuit 53 includes a shift register circuit, a decoder circuit, or a demultiplexer circuit, which is not illustrated. The data line drive circuit 53 supplies an image signal (Data) to each of the N data lines 43 in synchronization with selection of the scan line 42. The image signal is a digital signal having a potential of the first potential (VSS in the present exemplary embodiment) or the second potential (VDD in the present exemplary embodiment). Note that, to specify an image signal supplied to a data line 43 in a j-th column of the N data lines 43, the image signal is designated as an image signal Data j in the j-th column.

The enable lines 44 are electrically connected to the enable line drive circuit 54. The enable line drive circuit 54 outputs an enable signal unique to a row to each of the enable lines 44 divided into each row. The enable line 44 supplies this enable signal to the pixel circuit 41 in the corresponding row. The enable signal has an active state (active signal) and an inactive state (inactive signal), and the enable line 44 may be appropriately placed into the active state by receiving the enable signal from the enable line drive circuit 54.

Note that, to specify an enable signal supplied to an enable line 44 in the i-th row of the M enable lines 44, the enable signal is designated as an enable signal Enb i in the i-th row. The enable line drive circuit 54 may supply the active signal (or the inactive signal) as an enable signal to each row, or it may supply the active signal (or the inactive signal) as an enable signal simultaneously to a plurality of rows. In the present exemplary embodiment, the enable line drive circuit 54 supplies the active signal (or the inactive signal) simultaneously to all of the pixel circuits 41 located in the display region E through the enable lines 44.

The control device 55 includes a display signal supply circuit 56 and a video random access memory (VRAM) circuit 57. The VRAM circuit 57 temporarily stores a frame image and the like. The display signal supply circuit 56 generates a display signal (such as an image signal and a clock signal) from a frame image temporarily stored in the VRAM circuit 57 and supplies the display signal to the drive circuit 51.

In the present exemplary embodiment, the drive circuit 51 and the pixel circuits 41 are formed on the element substrate 11 (single-crystal silicon wafer in the present exemplary embodiment). Specifically, the drive circuit 51 and the pixel circuits 41 are each formed of a transistor element formed on the single-crystal silicon wafer.

The control unit 55 is formed of a semiconductor integrated circuit formed on a substrate (not illustrated) formed of a single-crystal semiconductor substrate different from the element substrate 11. The substrate on which the control unit 55 is formed is connected to the external connection terminals 13 provided on the element substrate 11 with a flexible printed circuit (FPC). A display signal is supplied from the control unit 55 to the drive circuit 51 through this flexible printed circuit.

Configuration of Pixel

Figure 6:
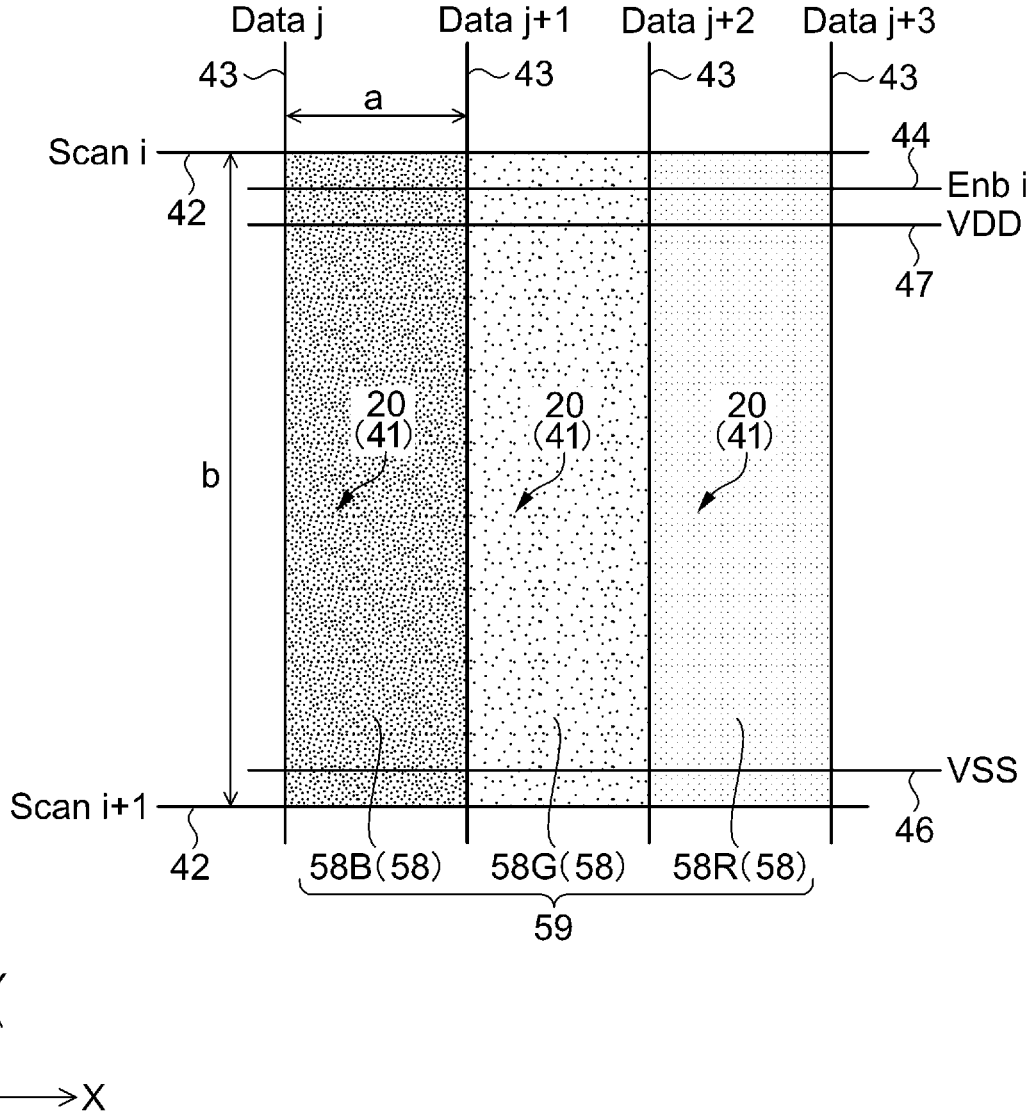
FIG. 6 shows a diagram illustrating a configuration of a pixel according to the present exemplary embodiment.

Next, a configuration of a pixel according to the present exemplary embodiment will be described with reference to FIG. 6. FIG. 6 is a diagram illustrating the configuration of the pixel according to the present exemplary embodiment.

As described above, in the electro-optic device 10, the pixel 59 including the sub-pixels 58 (the sub-pixel 58B, the sub-pixel 58G, and the sub-pixel 58R) forms a unit of display to display an image. In the present exemplary embodiment, the length a of the sub-pixel 58 in the row direction (X direction) is 4 micrometers (μm) and the length b of the sub-pixel 58 in the column direction (Y direction) is 12 micrometers (μm). In other words, the pitch at which the sub-pixels 48 are arranged in the row direction (X direction) is 4 micrometers (μm) and the pitch at which the sub-pixels 48 are arranged in the column direction (Y direction) is 12 micrometers (μm).

Each of the sub-pixels 58 includes the pixel circuit 41 including the light emitting element (LED) 20. The light emitting element 20 emits white light. The electro-optical device 10 includes a color filter (not illustrated) through which light emitted from the light emitting element 20 passes. The color filter includes color filters in colors corresponding to basic display colors p. In the present exemplary embodiment, the basic colors p=3, and color filters in respective colors of B, G, and R are disposed in the corresponding sub-pixels 58B, 58G, and 58R.

In the present exemplary embodiment, an organic electro luminescence (EL) element is used as one example of the light emitting element 20. The organic EL element may have an optical resonant structure that amplifies the intensity of light having a specific wavelength. Specifically, the organic EL element may be configured such that a blue component is extracted from the white light emitted from the light emitting element 20 in the sub-pixel 58B, a green component is extracted from the white light emitted from the light emitting element 20 in the sub-pixel 58G, and a red component is extracted from the white light emitted from the light emitting element 20 in the sub-pixel 58R.

In addition to the above-described example, assuming that basic color p=4, a color filter for a color other than B, G, and R, for example, a color filter for white light (sub-pixel 58 substantially without a color filter) may be prepared, or a color filter for light in another color such as yellow and cyan may be prepared. Furthermore, a light emitting diode element such as gallium nitride (GaN), a semiconductor laser element, and the like may be used as the light emitting element 20.

Digital Driving of Electro-Optical Device

Figure 7:
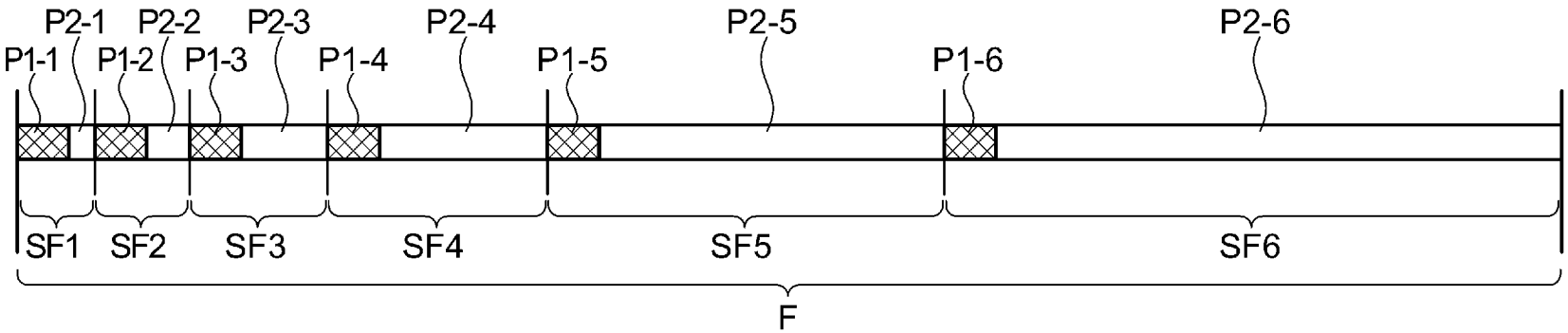
FIG. 7 shows a diagram illustrating digital driving of the electro-optical device according to the present exemplary embodiment.

Next, a method for displaying an image by digital driving in the electro-optical device 10 according to the present exemplary embodiment will be described with reference to FIG. 7. FIG. 7 is a diagram illustrating the digital driving of the electro-optical device according to the present exemplary embodiment.

The electro-optical device 10 displays a predetermined image in the display region E (see FIG. 4) by digital driving. In other words, the light emitting element 20 (see FIG. 6) disposed in each of the sub-pixels 58 can have either of a binary value of emission (bright state) or non-emission (dark display), so that the grey-scale of a displayed image depends on the ratio of emission period of each of the light emitting devices 20. This is referred to as time division driving.

As illustrated in FIG. 7, in the time division driving, one field (F) displaying one image is divided into a plurality of subfields (SFs) and the grey-scale display is expressed by controlling emission and non-emission of the light emitting element 20 for each of the subfields (SFs). An example in which a display with $2^6$=64 grey-scales is performed by a 6-bit time division grey-scale scheme will be described as one example here. In the 6-bit time division grey-scale scheme, one field F is divided into six subfields SF1 to SF6.

In FIG. 7, an i-th subfield in the one field F is designated as SFi and the six subfields from the first subfield SF1 to the sixth subfield SF6 are illustrated here. Each of the subfields SF includes a display period P2 (P2-1 to P2-6) as a second period and a non-display period (signal writing period) P1 (P1-1 to P1-6) as a first period as necessary.

Note that, the subfields SF1 to SF6 may not be distinguished from one another and may be collectively referred to as a subfield SF, the non-display periods P1-1 to P1-6 may not be distinguished from one another and may be collectively referred to as a non-display period P1, and the display periods P2-1 to P2-6 may not be distinguished from one another and may be collectively referred to as a display period P2 in this specification.

The light emitting element 20 is placed either in the emission state or non-emission state during the display period P2 and in the non-emission state during the non-display period (signal-writing period) P1. The non-display period P1 is used, for example, to write an image signal to a memory circuit 60 (see FIG. 8) and adjust display time. When the shortest subfield (for example, SF1) is relatively long, the non-display period P1 (P1-1) may be omitted.

In the 6-bit time division grey-scale scheme, the display period P2 (P2-1 to P2-6) of each of the subfields SFs is set such that (P2-1 of SF1):(P2-2 of SF2):(P2-3 of SF3):(P2-4 of SF4):(P2-5 of SF5):(P2-6 of SF6)=1:2:4:8:16:32. For example, if an image is displayed by a progressive scheme having a frame frequency of 30 Hz, then, one frame=one field (F)=33.3 milliseconds (msec).

In the above-described example, assuming that the non-display period P1 (P1-1 to P1-6) of each of the subfields SF is one millisecond, the display periods P2 are set such that (P2-1 of SF1)=0.434 milliseconds, (P2-2 of SF2)=0.868 milliseconds, (P2-3 of SF3)=1.735 milliseconds, (P2-4 of SF4)=3.471 milliseconds, (P2-5 of SF5)=6.942 milliseconds, and (P2-6 of SF6)=13.884 milliseconds.

Herein, given that the duration of the non-display period P1 is x (sec), the duration of the shortest display period P2 (the display period P2-1 in the first subfield SF1 in the above-described example) is y (sec), the bit number in grey-scale (=the number of subfields SF) is g, and the field frequency is f (Hz), then the relationship among them is expressed by Expression 1 below:

[Expression 1].

$$gx+(2^g-1)y=1/f \quad (1)$$

In the digital driving of the electro-optical device 10, a grey-scale display is achieved based on the ratio of a total display period P2 to a light emission period within one field F. For example, for black display with a grey-scale of "0", the light emitting element 20 is placed into non-emission in all of the display periods P2-1 to P2-6 of the six subfields SF1 to SF6. On the other hand, for white display with a grey-scale of "63", the light emitting element 20 is placed into emission during all of the display periods P2-1 to P2-6 of the six subfields SF1 to SF6.

To obtain a display of intermediate intensity with a grey-scale of, for example, "7" out of 64 grey-scales, the light emitting element 20 is caused to emit light during the display periods P2-1, P2-2, and P2-3 of the first, second and third subfields SF1, SF2, and SF3, respectively, and the light emitting element 20 is placed into non-emission during the display periods P2-4 to P2-6 of the other subfields SF4 to SF6. In this way, a display of intermediate grey-scale can be achieved by appropriately selecting emission or no-emission of the light emitting element 20 during the display period P2 for each of the subfields SF constituting the one field F.

According to a typical analog driven electro-optical device (organic EL device), grey-scale display is performed by analog control of a current flowing through an organic EL element according to the gate potential of a drive transistor, such that any variation in current-voltage characteristics and threshold voltage of the drive transistor may cause a variation in brightness and shift in grey-scale between pixels, resulting in a decreased display quality. On the other hand, when a compensating circuit that compensates for variations in current-voltage characteristics and threshold voltage of a drive transistor is provided as described in JP-A-2004-062199, a current also flows through the compensating circuit, causing an increase in power consumption.

Also in the typical organic EL device, an electric capacitance of a capacitive element that stores an image signal, that is an analog signal, needs to be increased in order to achieve more grey-scales of display. This requirement is a trade-off with high resolution (fine pixels) and may result in an increased power consumption due to charging and discharging of the capacitive element. In other words, in a typical organic EL device, an electro-optical device capable of displaying a high-resolution, multi-grey-scale, and high-quality image at low power consumption is difficult to achieve.

In the electro-optical device 10 according to the present exemplary embodiment, the light emitting element 20 is operated based on binary values of ON and OFF, so that the light emitting element 20 is placed into either of binary states of emission or non-emission. Thus, the electro-optical device 10 is less affected by variations in current-voltage characteristics or threshold voltage of a transistor than electro-optical device 10 operated by analog driving, so that a high-quality displayed image with less variations in brightness and less shift in grey-scale between the pixels 59 (sub-pixels 58) can be obtained. Furthermore, since a capacitive element in digital driving does not need to have a large capacitance as required in analog driving, not only can a finer pixel 59 (sub-pixels 58) be achieved, but the resolution can also be easily improved and the power consumption due to charging and discharging of a large capacitive element can be reduced.

Furthermore, the number of grey-scales can be easily increased by increasing the number g of the subfields SF constituting the one field F in digital driving of the electro-optical device 10. In this case, with the non-display period P1 as described above, the number of grey-scales can be increased by simply shortening the shortest display period P2. For example, when display is performed with 256 grey-scales assuming that g=8 in the progressive scheme at the frame frequency f=30 Hz, the duration y of the shortest display period (P2-1 of SF1) may be simply set to 0.100 millisecond by Expression 1 assuming that duration x of the non-display period P1=one millisecond.

As described later, in digital driving of the electro-optical device 10, the non-display period P1 as the first period may be assigned to a signal-writing period during which an image signal is written in the memory circuit 60 (or a signal-rewriting period during which an image signal is rewritten). Thus, 6-bit grey-scale display can be easily switched to 8-bit grey-scale display without changing the signal write period (i.e., without changing the clock frequency of the drive circuit 51).

Furthermore, in digital driving of the electro-optical device 10, the image signal in the memory circuit 60 (see FIG. 8) of a sub-pixel 58 for which display is to be changed is rewritten among the subfields SF or among the fields F. On the other hand, the image signal in the memory circuit 60 of a sub-pixel 58 for which display is not to be changed is not rewritten (maintained). As a result, the power consumption can be reduced. Accordingly, this configuration can achieve the electro-optical device 10 that can display a multi-grey-scale and high-resolution image with less variation in brightness and less shift in grey-scale between the pixels 59 (sub-pixels 58) while reducing energy consumption.

Example 1

Configuration of Pixel Circuit

Figure 8:
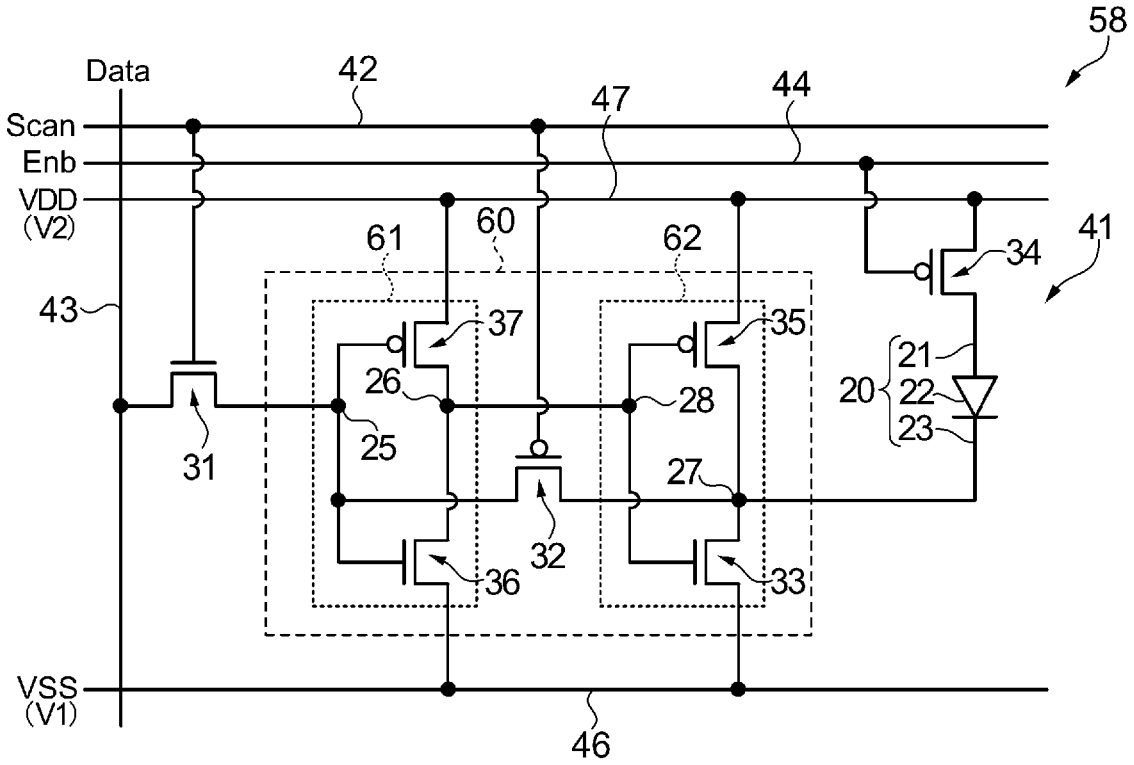
FIG. 8 shows a diagram illustrating a configuration of a pixel circuit according to Example 1.

Next, a configuration of a pixel circuit according to Example 1 will be described. First, a configuration of a pixel circuit according to Example 1 will be described with reference to FIG. 8. FIG. 8 is a diagram illustrating the configuration of the pixel circuit according to Example 1.

As illustrated in FIG. 8, a pixel circuit 41 is provided for each of sub-pixels 58 disposed at intersections of scan lines 42 and data lines 43. The enable line 44 is disposed along the scan line 42. A scan line 42, a data line 43, and an enable line 44 correspond to each of the pixel circuits 41. To each of the pixel circuits 41, the low potential line 46 supplies the first potential (V1) and the high potential line 47 supplies the second potential (V2). As described above, in the present exemplary embodiment (Example 1), the first potential is V1=VSS=2.0 V, and the second potential is V2=VDD=7.0 V as one example.

The pixel circuit 41 according to Example 1 includes the light emitting element 20, the memory circuit 60, a first N-type transistor 31, and a fourth P-type transistor 34. The memory circuit 60 incorporated in the pixel circuit 41 enables digital driving of the electro-optical device 10 and helps reduce the variation in the luminance of the light emitting element 20 among the sub-pixels 58 as compared to analog driving and thus, the variation in display among the pixels 59.

The light emitting element 20 is an organic EL element in Example 1, and includes an anode (pixel electrode) 21, a light emitting unit (light emission functional layer) 22, and a cathode (counter electrode) 23. The light emitting unit 22 is configured to emit light by a part of energy being discharged as fluorescence or phosphorescence when an exciton is formed by a positive hole injected from the anode 21 side and an electron injected from the cathode 23 side and the exciton disappears (the positive hole recombines with the electron).

In the pixel circuit 41 according to Example 1, the light emitting element 20 is disposed between an output terminal 27 of a second inverter 62 of the memory circuit 60 and the second potential line (high potential line 47). The anode 21 of the light emitting element 20 is electrically connected to the drain of the fourth transistor 34. The cathode 23 of the light emitting element 20 is electrically connected to the output terminal 27 of the second inverter 62 (the drain of a third transistor 33 and a fifth transistor 35). In the pixel circuit 41 according to Example 1, the cathode 23 corresponds to a first terminal of the light emitting element 20.

The memory circuit 60 is disposed between the first potential line (low potential line 46) and the second potential line (high potential line 47). The memory circuit 60 includes a first inverter 61, the second inverter 62, and a second transistor 32 of the P-type. The memory circuit 60 includes these two inverters 61 and 62 connected to each other in a circle to constitute a so-called static memory that stores an image signal, which is a digital signal for the light emitting element 20.

An output terminal 26 of the first inverter 61 is electrically connected to an input terminal 28 of the second inverter 62. The second transistor 32 is disposed between the output terminal 27 of the second inverter 62 and an input terminal 25 of the first inverter 61. In other words, one of the source and the drain of the second transistor 32 is electrically connected to the input terminal 25 of the first inverter 61, and the other is electrically connected to the output terminal 27 of the second inverter 62.

Note that, the state where a terminal A, e.g. output terminal or input terminal, is electrically connected to a terminal B in this specification represents a state where the logic of the terminal A may be identical to the logic of the terminal B. For example, even when a transistor, a resistor, a diode, or the like are arranged between the terminal A and the terminal B, the terminals is considered to be electrically connected if the logics are the same. Further, "dispose" as used in an expression such as "a transistor and other elements are disposed between A and B" does not mean how these elements are disposed on an actual lay-out, but means how these elements are disposed in a circuit diagram.

An image signal (digital signal) stored in the memory circuit 60 has a binary value of High or Low. In Example 1, the light emitting element 20 is in a state that allows emission when the potential of the output terminal 26 of the first inverter 61 (=the input terminal 28 of the second inverter 62) is High, that is, when the potential of the output terminal 27 of the second inverter 62 is Low. The light emitting element 20 is in a non-emission state when the potential of the output terminal 26 of the first inverter 61 (=the input terminal 28 of the second inverter 62) is Low, that is, when the potential of the output terminal 27 of the second inverter 62 is High.

In Example 1, the two inverters 61 and 62 constituting the memory circuit 60 are disposed between the first potential line (low potential line 46) and the second potential line (high potential line 47) and VSS as the first potential (V1) and VDD as the second potential (V2) are supplied to the two inverters 61 and 62. Therefore, High of the image signal corresponds to the second potential (VDD) and Low corresponds to the first potential (VSS).

The first inverter 61, which includes a sixth N-type transistor 36 and a seventh P-type transistor 37, has a CMOS configuration. The sixth transistor 36 and the seventh transistor 37 are disposed in series between the first potential line (low potential line 46) and the second potential line (high potential line 47). The source of the sixth transistor 36 is electrically connected to the first potential line (low potential line 46). The source of the seventh transistor 37 is electrically connected to the second potential line (high potential line 47).

Note that, the source potential is compared with the drain potential and the one having a lower potential is the source in the N-type transistor. A source potential is compared with a drain potential and the one having a higher potential is a source in the P-type transistor.

The second inverter 62, which includes a third N-type transistor 33 and a fifth P-type transistor 35, has a CMOS configuration. The third transistor 33 and the fifth transistor 35 are disposed in series between the first potential line (low potential line 46) and the second potential line (high potential line 47). The source of the third transistor 33 is electrically connected to the first potential line (low potential line 46). The source of the fifth transistor 35 is electrically connected to the second potential line (high potential line 47). As described later, the third transistor 33 also functions as a drive transistor of the light emitting element 20.

The input terminal 25 of the first inverter 61, which serves as the gate of the sixth transistor 36 and the seventh transistor 37, is electrically connected to one of the source and the drain of the second transistor 32. The output terminal 26 of the first inverter 61, which serves as the drain of the sixth transistor 36 and the seventh transistor 37, is electrically connected to the input terminal 28 of the second inverter 62.

The input terminal 28 of the second inverter 62, which serves as the gate of the third transistor 33 and the fifth transistor 35, is electrically connected to the output terminal 26 of the first inverter 61. The output terminal 27 of the second inverter 62, which serves as the drain of the third transistor 33 and the fifth transistor 35, is electrically connected to the other of the source and the drain of the second transistor 32. The output terminal 27 of the second inverter 62, i.e. the drain of the third transistor 33 and the drain of the fifth transistor 35, is electrically connected to the cathode 23, i.e. first terminal, of the light emitting element 20.

The gate of the second transistor 32 is electrically connected to the scan line 42. While the second transistor 32 is in the ON-state, the input terminal 25 of the first inverter 61 (namely, the gate of the sixth transistor 36 and the gate of the seventh transistor 37) is electrically connected to the output terminal 27 of the second inverter 62 (namely, the drain of the third transistor 33 and the drain of the fifth transistor 35).

Both of the first inverter 61 and the second inverter 62 in Example 1 have the CMOS configuration. In addition to this configuration the inverters 61 and 62 may be formed of a transistor and a resistor. More specifically, in each of the first inverter 61 and the second inverter 62, one of the transistors not functioning as a drive transistor may be replaced with a resistor. For example, one of the sixth transistor 36 and the seventh transistor 37 in the first inverter 61 may be replaced with a resistor, or the fifth transistor 35 in the second inverter 62 may be replaced with a resistor.

The first transistor 31 is a selection transistor for the pixel circuit 41. The first transistor 31 is disposed between the input terminal 25 of the first inverter 61 of the memory circuit 60 and the data line 43. In other words, one of the source and the drain of the first transistor 31 is electrically connected to the data line 43 while the other is electrically connected to the input terminal 25 of the first inverter 61 (namely, the gate of the sixth transistor 36 and the gate of the seventh transistor 37). The gate of the first transistor 31 is electrically connected to the scan line 42.

The first transistor 31 is the N-type as a first conductive type, and the second transistor 32 is the P-type as a second conductive type different from the first conductive type. The gate of the first transistor 31 and the gate of the second transistor 32 are electrically connected to the scan line 42. The first transistor 31 and the second transistor 32 operate in a complementary manner to each other in response to a scan signal (selection signal or non-selection signal) supplied to the scan line 42.

In Example 1, since the first transistor 31 that serves as the selection transistor is the N-type, the scan signal in the selection state, i.e. selection signal, is High (high potential) and the scan signal in the non-selection state, i.e. non-selection signal, is Low (low potential). While the selection signal is supplied to the scan line 42, the first transistor 31 is in the ON-state, and the second transistor 32 is in the OFF-state. While the non-selection signal is supplied to the scan line 42, the first transistor 31 is in the OFF-state, and the second transistor 32 is in the ON-state.

When the selection signal is supplied to the scan line 42 and the first transistor 31 is turned into the ON-state, the data line 43 is electrically connected to the input terminal 25 of the first inverter 61 so that the image signal is introduced from the data line 43 to the memory circuit 60 through the first transistor 31. When the image signal of Low is introduced to the input terminal 25 of the first inverter 61, the potential of the output terminal 26 of the first inverter 61 (=the input terminal 28 of the second inverter 62) becomes High and the potential of the output terminal 27 of the second inverter 62 becomes Low. Upon this, since the second transistor 32 is in the OFF-state, the input terminal 25 of the first inverter 61 is disconnected from the output terminal 27 of the second inverter 62.

When the non-selection signal is supplied to the scan line 42 and the second transistor 32 is turned into the ON-state, the input terminal 25 of the first inverter 61 is electrically connected to the output terminal 27 of the second inverter 62. If the potential of the output terminal 27 of the second inverter 62 is Low, the potential of the input terminal 25 of the first inverter 61 is Low or close to Low, such that the potential of the output terminal 26 of the first inverter 61 (=the input terminal 28 of the second inverter 62) is High, and thus the output terminal 27 of the second inverter 62 stably keeps Low potential. Upon this, since the first transistor 31 is in the OFF-state, the input terminal 25 of the first inverter 61 is electrically disconnected from the data line 43 to prevent the image signal from being introduced to the memory circuit 60. Therefore, the image signal stored in the memory circuit 60 is maintained in a stable state until the new image signal is introduced next time.

Note that, as will be described later, the potential of the non-selection signal is lower than the first potential and the second potential in the present exemplary embodiment. As a result, over a period during which the non-selection signal is supplied to the scan line 42 the second transistor 32 will be in the ON-state even though the potential of the output terminal 27 of the second inverter 62 is Low, and therefore the input terminal 25 of the first inverter 61 will keep Low potential. In such a manner, it is preferable that the drive conditions such as the first potential, the second potential, and the potential of non-selection signal are determined to satisfy the condition that when the non-selection signal is supplied, the second transistor 32 is in the ON-state regardless of whether the image signal maintained in the memory circuit 60 is High or Low. In this way, the signal stored in the memory circuit 60 is maintained reliably.

The fourth transistor 34 is disposed in series with the light emitting element 20 between the output terminal 27 of the second inverter 62 and the second potential line (high potential line 47). The fourth transistor 34 is a control transistor that controls emission of the light emitting element 20. The fourth transistor 34 switches between the ON-state and the OFF-state in response to an enable signal, i.e. active signal or inactive signal, supplied to the enable line 44. While the fourth transistor 34 is in the ON-state, the light emitting element 20 emits light.

The gate of the fourth transistor 34 is electrically connected to the enable line 44. The source of the fourth transistor 34 is electrically connected to the second potential line (high potential line 47). The drain of the fourth transistor 34 is electrically connected to the anode 21 of the light emitting element 20. In other words, the fourth P-type transistor 34 is disposed on the high potential side with respect to the light emitting element 20.

Since the fourth transistor 34 is the P-type in Example 1, the enable signal in the active state (active signal) is Low (low potential) and the enable signal in the inactive state (inactive signal) is High (high potential). While the active signal is supplied to the enable line 44, the fourth transistor 34 is in the ON-state. Upon this, the light emitting element 20 can emit light. While the inactive signal is supplied to the enable line 44, the fourth transistor 34 is in the OFF-state. Upon this, the light emitting element 20 does not emit light.

The light emitting element 20 and the third transistor 33 of the second inverter 62 are disposed in series between the fourth transistor 34 and the first potential line (low potential line 46). The third N-type transistor 33 is disposed on the low potential side with respect to the light emitting element 20. As described above, the third transistor 33 functions as a drive transistor for the light emitting element 20. In other words, while the third transistor 33 is in the ON-state, the light emitting element 20 can emit light.

When the active signal is supplied to the enable line 44, the fourth transistor 34 turns into the ON-state. In this state, when the potential of the input terminal 28 of the second inverter 62 is placed into High and the third transistor 33 turns into the ON-state, the electric current flows from the second potential line (high potential line 47) to the first potential line (low potential line 46) through the fourth transistor 34, the light emitting element 20, and the third transistor 33. In this way, a current flows through the light emitting element 20 to cause the light emitting element 20 to emit light.

Since the fourth P-type transistor 34 is disposed on the high potential side with respect to the light emitting element 20 and since the third N-type transistor 33 is disposed on the low potential side with respect to the light emitting element 20, the third transistor 33 and the fourth transistor 34 are substantially operated in a linear region (hereinafter simply expressed as "linearly operated") when the light emitting element 20 emits light. Accordingly, any variation in the threshold voltage of the third transistor 33 and the fourth transistor 34 does not affect display characteristics such as light emission intensity of the light emitting element 20.

A method for controlling the first transistor 31, the second transistor 32 and the fourth transistor 34 in the pixel circuit 41 according to Example 1 to cause writing (or rewriting) of an image signal to the memory circuit 60 and cause emission and non-emission of the light emitting element 20 will now be described.

In Example 1, since the enable line 44 and the scan line 42 are independent each other for each of the pixel circuits 41, the first and second transistors 31 and 32 operate independently from the fourth transistor 34. Then, the first transistor 31 and the second transistor 32 operate in a complementary manner to each other in response to the same scan signal. As a result, while the fourth transistor 34 is in the OFF-state, the first transistor 31 is turned into the ON-state and the second transistor 32 is turned into the OFF-state.

In other words, while the fourth transistor 34 is in the OFF-state, an image signal is written (or rewritten) to the memory circuit 60. When the first transistor 31 receives the selection signal to be turned into the ON-state, the image signal is supplied to the memory circuit 60 that consists of the first inverter 61 and the second inverter 62. The image signal is written from the data line 43 to the first inverter 61, and then from the first inverter 61 to the second inverter 62. When the first transistor 31 is in the ON-state, the second transistor 32 is in the OFF-state, so that the output terminal 27 of the second inverter 62 is electrically disconnected from the input terminal 25 of the first inverter 61.

To understand present invention clearly, we consider an imaginary circuit, in which the second transistor 32 does not exist and therefore the output terminal 27 of the second inverter 62 is always connected to the input terminal 25 of the first inverter 61. When the input terminal 25 of the first inverter 61 in the imaginary circuit is rewritten from Low (VSS) to High (VDD), before a High signal is introduced to the input terminal 25 of the first inverter 61, its potential was Low, the potential of the input terminal 28 of the second inverter 62 was High, and the third transistor 33 was in the ON-state.

When the first transistor 31 in the imaginary circuit turns into the ON-state and the High signal (VDD) is introduced from the data line 43, electric current flows from the data line 43, to which VDD is supplied at the current situation, to the low potential line 46 (VSS) through the first transistor 31 and the third transistor 33. This may cause an operational failure that it takes undesirably a long time to rewrite the potential of the input terminal 25 from Low to High or that the potential is not rewritten.

We also consider another malfunction of the imaginary circuit. When the input terminal 25 of the first inverter 61 in the imaginary circuit is rewritten from High (VDD) to Low (VSS), before the Low signal is introduced to the input terminal 25 of the first inverter 61, the potential of the input terminal 28 of the second inverter 62 was Low and the fifth transistor 35 was in the ON-state. Then, when the first transistor 31 turns into the ON-state and the Low signal (VSS) is introduced from the data line 43, electric current flows from the high potential line 47 (VDD) to the data line 43, to which VSS is supplied at the current situation, through the fifth transistor 35 and the first transistor 31. This may cause an operational failure that it takes undesirably a long time to rewrite the potential of the input terminal 25 from High to Low or that the potential is not rewritten.

The above-described operational failure is prevented in Example 1. When an image signal is written (or rewritten) to the memory circuit 60 with the first transistor 31 being in the ON-state, the second transistor 32 disposed between the input terminal 25 of the first inverter 61 and the output terminal 27 of the second inverter 62 is in the OFF-state, resulting in the electrical disconnection between the input terminal 25 and the output terminal 27. Thus the above-described operational failure is prevented in Example 1. In addition, the fourth transistor 34 is in the OFF-state while the first transistor 31 is in the ON-state. Thus, the light emitting element 20 does not emit light while an image signal is being written to the memory circuit 60. In other words, the electric path leading from the second potential line (high potential line 47) to the first potential line (low potential line 46) through the light emitting element 20 and the third transistor 33 is disconnected by the fourth transistor 34. In this way, the image signal is written (or rewritten) to the memory circuit 60 in a quick and reliable manner.

To understand present invention clearly, we consider another imaginary circuit, in which the complementary data line and a complementary transistor for the first transistor 31 are added. In this imaginary circuit, while an image signal is written to the first inverter 61 from the data line 43, a complementary image signal (complementary signal) of the image signal supplied to the data line 43 is written to the second inverter 62 from the complementary data line. By contrast, in the pixel circuit 41 in Example 1, when an image signal is written (or rewritten) to the memory circuit 60, the image signal is written from the data line 43 to the first inverter 61 and then a reverse signal (complementary signal) of the image signal is written from the first inverter 61 to the second inverter 62. This eliminates the need for a complementary data line and a complementary transistor for the first transistor 31 presented in the imaginary circuit. Accordingly, a higher resolution display that possesses finer pixels 59 is easily achieved and the manufacturing yield is improved in Example 1 compared to the imaginary circuit. This is because neither a complementary data line nor a complementary transistor is required in the pixel circuit 41 in Example 1.

When the first transistor 31 is switched from the ON-state to the OFF-state by the non-selection signal, the second transistor 32 is turned into the ON-state. In this way, the image signal written to the memory circuit 60 is maintained between the first inverter 61 and the second inverter 62. With the first transistor 31 in the OFF-state, the image signal stored in the memory circuit 60 is maintained in a stable state without being mistakenly rewritten. The fourth transistor 34 remains in the OFF-state until the active signal is supplied, so that the light emitting element 20 does not emit light.

After that, when the fourth transistor 34 is turned into the ON-state by the active signal while the first transistor 31 remains in the OFF-state and the second transistor 32 remains in the ON-state, the light emitting element 20 is ready to emit light. Upon this, if the third transistor 33 is in the ON-state due to the image signal stored in the memory circuit 60, an electric current flows from the second potential line (high potential line 47) to the first potential line (low potential line 46) through the fourth transistor 34, the light emitting element 20, and the third transistor 33 to cause the light emitting element 20 to emit light.

While the fourth transistor 34 is in the ON-state, the first transistor 31 is in the OFF-state and the second transistor 32 is in the ON-state, such that the image signal stored in the memory circuit 60 is maintained and is not rewritten even while the light emitting element 20 emits light. In this way, a high-quality image display without false display is achieved. As a result, grey-scale by time division is accurately expressed by controlling the ratio of emission to non-emission of the light emitting element 20, such that the electro-optical device 10 capable of displaying a high-resolution, multi-grey-scale, and high-quality image at a low power consumption is achieved at a low cost.

Potential of Each Signal

Next, a potential of each signal in the pixel circuit 41 according to Example 1 will be described. In Example 1, the drive circuit 51 and the memory circuit 60 are operated by a power supply supplied with a first potential (V1=VSS=2.0 V as one example) and a second potential (V2=VDD=7.0 V as one example). The image signal supplied from the data line 43 to the memory circuit 60 is either the first potential (V1) or the second potential (V2). In the present example, a potential corresponding to High is the second potential (V2) and a potential corresponding to Low is the first potential (V1).

For the scan signal that consists of selection signal and non-selection signal, since the first transistor 31 is the N-type and the second transistor 32 is the P-type, the selection signal for turning the first transistor 31 into the ON-state and the second transistor 32 into the OFF-state is a high potential. Further, the non-selection signal for turning the first transistor 31 into the OFF-state and the second transistor 32 into the ON-state is a low potential. The potential of the selection signal is designated as a fourth potential (V4), and the potential of the non-selection signal is designated as a third potential (V3).

Since High of the image signal is the second potential (V2), the fourth potential (V4) of the selection signal is set to be higher than or equal to the second potential (V2). The fourth potential (V4) of the selection signal is preferably the second potential (V2) (that is, V4=V2=7.0 V) in order not to increase the number of power supplies. This ensures that the first transistor 31 is turned into the ON-state and the second transistor 32 into the OFF-state by the selection signal without increasing the number of power supplies.

Further, since Low of the image signal is the first potential (V1), the third potential (V3) of the non-selection signal is set to be lower than or equal to the first potential (V1). Furthermore, representing the threshold voltage of the second transistor 32 by $V_{th2}$ ($V_{th2}$=−0.36 V as one example), the third potential (V3) as the non-selection signal is set to be less than the sum of the first potential (V1) and the threshold voltage $V_{th2}$ of the second transistor 32, i.e. $V3<V1+V_{th2}$. In the present example, the third voltage (V3) is set to be zero volts (V3=0V) as an example. Since the second transistor 32 is the P-type, the condition of $V3<V1+V_{th2}$ turns the second transistor 32 into ON-state, even though the potential of the output terminal 27 is Low, namely first potential. This is because the absolute value of the gate-source voltage of the second transistor 32 is greater than the absolute value of the threshold voltage $V_{th2}$ of the second transistor 32. In other words, this is because the gate-source voltage (V3−V1) of the second transistor 32 is smaller than the threshold voltage $V_{th2}$ of the second transistor 32.

As in the present example, as long as the third potential (V3) has a value (V3=0 V) lower than the sum of the first potential (V1=2 V) and the threshold voltage ($V_{th2}$=−0.36 V) of the second transistor 32 ($V1+V_{th2}$=1.64 V), the absolute value of the gate-source voltage of the second transistor 32 is sufficiently greater than the absolute value of the threshold voltage $V_{th2}$ of the second transistor 32. Thus, the second transistor 32 is reliably turned into the ON-state by the non-selection signal while the first transistor 31 is in the OFF-state.

It is preferable that the second transistor 32 and the fourth transistor 34 are of the same conductive type. In other words, when the first transistor 31 is a first conductive type and the second transistor 32 is a second conductive type, the fourth transistor 34 is preferably the second conductive type. For the present example, the second transistor 32 is the P-type, and thus the fourth transistor 34 is preferably the P-type. This is described below.

For the enable signal that consists of active signal and inactive signal, since the fourth transistor 34 is the P-type, the active signal for turning the fourth transistor 34 into the ON-state is a low potential and the inactive signal for turning the fourth transistor 34 into the OFF-state is a high potential. The potential of the active signal is designated as a fifth potential (V5) and the potential of the inactive signal is designated as a sixth potential (V6).

The fifth potential (V5) of the active signal is set to be as lower as possible than the second potential (V2), which is the source potential of the fourth transistor 34, and is preferably set to the third potential (V3), namely V5=V3=0 V. When the potential of the active signal is V5=0 V, the absolute value of the gate-source voltage of the fourth transistor 34 is sufficiently greater than the absolute value of the threshold voltage $V_{th4}$ ($V_{th4}$=−0.36 V as an example) of the fourth transistor 34 and thus, the fourth transistor 34 is turned into the ON-state reliably by the active signal and the ON-resistance in the ON-state is lowered. In this way, when the second transistor 32 and the fourth transistor 34 are of the same conductive type, the ON-resistance of the fourth transistor 34 is reduced by using the third potential (V3) introduced for reducing the ON-resistance of the second transistor 32 as the fifth potential (V5) of the active signal.

Further, the sixth potential (V6) of the inactive signal is set to be greater than or equal to the second potential (V2) and is preferably set to the second potential (V2), namely V6=V2=7.0 V. In this case, when the inactive signal is supplied to the fourth transistor 34, the gate-source voltage of the fourth transistor 34 is 0 V, such that the fourth transistor 34 is turned into the OFF-state reliably by the inactive signal.

Therefore, in addition to the first potential (V1=2.0 V as one example) and the second potential (V2=7.0 V as one example), both of which are supplied to the memory circuit 60 to be operated, an introduction of the third potential (V3=0 V as one example) ensures a reliable ON-state of the second transistor 32 and the fourth transistor 34 and especially the linear operation of the fourth transistor 34 in ON-state while operating the drive circuit 51 and the memory circuit 60 at a high speed.

Characteristic of Transistor

Next, characteristics of transistors provided in the pixel circuit 41 according to Example 1 will be described. In the pixel circuit 41 according to Example 1, the ON-resistance of the fourth transistor 34 disposed in series with the light emitting element 20 is preferably sufficiently lower than the ON-resistance of the light emitting element 20. The term "sufficiently low" refers to a drive condition in which the fourth transistor 34 can operate linearly and specifically, to a condition where the ON-resistance of the fourth transistor 34 is less than or equal to 1/100, preferably, less than or equal to 1/1000 of the ON-resistance of the light emitting element 20. In this way, when the light emitting element 20 emits light, the fourth transistor 34 can be linearly operated.

As will be described later, the ON-resistance of the third transistor 33 is preferably less than or equal to the ON-resistance of the fourth transistor 34. When the ON-resistance of the third transistor 33 is less than or equal to the ON-resistance of the fourth transistor 34, the ON-resistance of the fourth transistor 34 is sufficiently lower than the ON-resistance of the light emitting element 20. Accordingly, the ON-resistance of the third transistor 33 is also sufficiently lower than the ON-resistance of the light emitting element 20.

When the ON-resistance of the fourth transistor 34 and the ON-resistance of the third transistor 33 are sufficiently lower than the ON-resistance of the light emitting element 20 as described above, both the fourth transistor 34 and the third transistor 33 can be linearly operated when a current flows through the light emitting element 20 to cause it to emit light. In this way, most of the potential drop (namely, the potential difference between the first potential and the second potential as the power supply voltage) across the fourth transistor 34, the light emitting element 20 and the third transistor 33 that are disposed in series in the path leading from the second potential line (the high potential line 47) to the first potential line (the low potential line 46) applies to the light emitting element 20.

As a result, the influence of variation in the threshold voltage of the fourth transistor 34 or the third transistor 33 during emission of the light emitting element 20 is decreased. In other words, with such a configuration, the influence of variation in the threshold voltage of the fourth transistor 34 or the third transistor 33 can be reduced. As a result, the variation in brightness and the shift in grey-scale between the pixels 59 (sub-pixels 58) can be suppressed and an image display having excellent uniformity can be achieved.

For example, when the ON-resistance of the fourth transistor 34 is 1/100 of the ON-resistance of the light emitting element 20, the ON-resistance of the third transistor 33 is also lower than or equal to 1/100 of the ON-resistance of the light emitting element 20. In this case, greater than or equal to 98% (substantially greater than or equal to approximately 99%) of the power supply voltage applies to the light emitting element 20, such that the potential drop across the fourth transistor 34 and the third transistor 33 will be 2% or less (substantially less than or equal to approximately 1%). Accordingly, the influence that the variation in the threshold voltage of both of the transistors 33 and 34 will have on the emission characteristics of the light emitting element 20 is significantly reduced. In this way, an image display can be achieved that has a decreased variation in brightness and a decreased shift in grey-scale between the pixels 59 including the sub-pixels 58 each placed into the selection state.

Furthermore, the ON-resistance of the third transistor 33 is preferably less than or equal to half of the ON-resistance of the fourth transistor 34. In this case, the ON-resistance of the third transistor 33 is lower than or equal to 1/200 of the ON-resistance of the light emitting element 20.

Further, when the ON-resistance of the fourth transistor 34 is 1/1000 of the ON-resistance of the light emitting element 20, the ON-resistance of the third transistor 33 is also lower than or equal to 1/1000 of the ON-resistance of the light emitting element 20. When the ON-resistance of the third transistor 33 is less than or equal to half of the ON-resistance of the fourth transistor 34, the ON-resistance of the third transistor 33 is lower than or equal to 1/2000 of the ON-resistance of the light emitting element 20. As a result, the series resistance of both of these transistors 33 and 34 is lower than or equal to approximately 1/1000 of the ON-resistance of the light emitting element 20.

In this case, since greater than or equal to approximately 99.9% of the power supply voltage applies to the light emitting element 20 such that the potential drop across both the transistors 33 and 34 is less than or equal to approximately 0.1%, the influence that the variation in the threshold voltage of both the transistors 33 and 34 will have on the emission characteristics of the light emitting element 20 is almost negligible. As a result, a high-quality image display can be achieved in which the variation in brightness and the shift in grey-scale among the pixels 59 are decreased.

The ON-resistance of a transistor depends on the polarity, gate length, gate width, threshold voltage, gate-source voltage, gate insulating film thickness, and the like of the transistor. In Example 1, the polarity, gate length, gate width, threshold voltage, gate-source voltage, gate insulating film thickness, and the like of the transistor are determined to satisfy the above-described conditions. This is described below.

In Example 1, the organic EL element is used in the light emitting element 20, and the transistors such as the third transistor 33 and the fourth transistor 34 are formed on the element substrate 11 formed of a single-crystal silicon wafer. The current-voltage characteristics of the light emitting element 20 are represented approximately by the following Equation (2):

[Expression 2]

$$I_{EL} = L_{EL} W_{EL} J_0 \left\{ \exp\left( \frac{V_{EL} - V_0}{V_{tm}} \right) - 1 \right\} \tag{2}$$

In Expression 2, $I_{EL}$ is a current flowing through the light emitting element 20, $V_{EL}$ is a voltage applied to the light emitting element 20, $L_{EL}$ is the length of the light emitting element 20, $W_{EL}$ is the width of the light emitting element 20, $J_0$ is the current density coefficient of the light emitting element 20, $V_{tm}$ is the coefficient voltage of the light emitting element 20 having a temperature dependency (a constant voltage under a constant temperature), and $V_0$ is a threshold voltage for emission of light of the light emitting element 20.

Given that the power supply voltage is represented as $V_P$ and the potential drop across the fourth transistor 34 and the third transistor 33 is represented as $V_{ds}$, the following relation holds: $V_{EL}+V_{ds}=V_P$. In Example 1, $L_{EL}$=11 micrometers (μm), $W_{EL}$=3 micrometers (μm), $J_0$=1.449 milliamperes per square centimeters (mA/cm$^2$), $V_0$=2.0 volts (V), and $V_{tm}$=0.541 volt (V).

Provided that the power supply voltage $V_P$ is $V_P$=V2−V1 and the fourth transistor 34 and the third transistor 33 operate linearly, the current-voltage characteristics of the light emitting element 20 can be approximated by the following Expression 3 using $V_{ds}$, at $V_{ds}$=approximately 0 V:

[Expression 3].

$$I_{EL}=-kV_{ds}+I_0 \tag{3}$$

For Example 1, the coefficient k defined by Expression 3 is such that: k=2.27×10$^{-7}$ (Ω$^{-1}$). $I_0$ is the amount of current when all power supply voltage $V_P$ is applied to the light emitting element 20, and $I_0$=1.222×10$^{-7}$ (A).

On the other hand, the drain current $I_{dsi}$ of an i-th transistor (where i is 3 or 4) such as the fourth transistor 34 and the third transistor 33 is expressed by the following Expression 4:

[Expression 4]

$$I_{dsi} = \frac{W_i}{L_i} \cdot \frac{\varepsilon_0 \varepsilon_{ox}}{t_{oxt}} \cdot \mu_i (V_{gsi} - V_{thi}) V_{dsi} \equiv Z_i (V_{gsi} - V_{thi}) V_{dsi}. \tag{4}$$

In Expression 4, $W_i$ is the gate width of the i-th transistor, $L_i$ is the gate length of the i-th transistor, $\varepsilon_0$ is the permittivity of vacuum, $\varepsilon_{ox}$ is the permittivity of a gate insulating film, $t_{oxi}$ is the thickness of the gate insulating film of an i-th transistor, $\mu_i$ is the mobility of the i-th transistor, $V_{gsi}$ is the gate voltage of the i-th transistor, $V_{dsi}$ is the drain voltage of the i-th transistor (potential drop by the i-th transistor), and $V_{thi}$ is the threshold voltage of the i-th transistor.

In Example 1, $W_4$=0.75 micrometer (μm), $W_3$=1.0 micrometer (μm), $L_4$=0.75 micrometer (μm), $L_3$=0.5 micrometer (μm), $t_{ox4}=t_{ox3}$=20 nanometers (nm), $\mu_4$=150 square centimeters per volt per second ($cm^2/V\cdot s$), $\mu_3$=240 square centimeters per volt per second ($cm^2/V\cdot s$), $V_{th4}$=−0.36 V, $V_{th3}$=0.36 V, $V_{gs4}$=V3−V2=0 V−7.0 V=−7.0 V, and $V_{gs3}$=V2−V1=7.0 V−2.0 V=5.0 V.

In this way, the gate length $L_3$ of the third transistor 33 may be set to be shorter than the gate length $L_4$ of the fourth transistor 34. This is preferred as it makes it easy to achieve the ON-resistance of the third transistor 33 that is less than or equal to the ON-resistance of the fourth transistor 34. Further, the third transistor 33 may be set to be the N-type and the fourth transistor 34 may be set to be the P-type. This is preferred as it makes it easy to achieve the ON-resistance of the third transistor 33 that is less than or equal to the ON-resistance of the fourth transistor 34.

Under such a condition, a voltage of light emitted by the light emitting element 20 is a voltage such that $I_{EL}=I_{dsi}$ in Expressions 2 and 4. In Example 1, $V_P$=V2−V1=5.0 V, $V_{ds4}$=−0.0007 V, $V_{ds3}$=0.0003 V, $V_{EL}$=4.9990 V, $I_{EL}=I_{ds4}=I_{ds3}=1.219\times10^{-7}$ A. Upon this, the ON-resistance of the fourth transistor 34 was $5.818\times10^3\Omega$, the ON-resistance of the third transistor 33 was $2.602\times10^3\Omega$, and the ON-resistance of the light emitting element 20 was $4.100\times10^7\Omega$.

Therefore, the ON-resistance of the third transistor 33 was approximately 1/16000 of the ON-resistance of the light emitting element 20, which is lower than 1/1000, and the ON-resistance of the fourth transistor 34 was approximately 1/7000 of the ON-resistance of the light emitting element 20, which is also lower than 1/1000. Thus, most of the power supply voltage applied to the light emitting element 20. Under this condition, even when the threshold voltage of a transistor varies greater than or equal to 80% (even when $V_{th3}$ and $V_{th4}$ varies between 0.27 V and 0.86 V in the above-described example), $V_{EL}$=4.999 V and $I_{EL}=I_{ds1}=I_{ds3}=1.22\times10^{-7}$ A are invariable.

In general, the threshold voltage of the transistor does not vary significantly in such a manner. Accordingly, by reducing the ON-resistance of the fourth transistor 34 to lower than or equal to approximately 1/1000 of the ON-resistance of the light emitting element 20, the influence that the variation in the threshold voltage of the third transistor 33 and the fourth transistor 34 have on the amount of emission of the light emitting element 20 can be substantially eliminated.

By simultaneously solving Equation (3) and Equation (4) with $I_{EL}=I_{dsi}$, the influence of variation in the threshold voltage of the third transistor 33 and the fourth transistor 34 on $I_{EL}=I_{dsi}$ can be approximated by the following Expression 5:

[Expression 5]

$$\left(1+\frac{k}{Z_i(V_{gsi}-V_{thi})}\right)I_{EL}=I_0. \tag{5}$$

Since $I_0$ is the amount of current when all the power supply voltage $V_P$ applies to the light emitting element 20, $V_{gsi}$ and $Z_i$ may be increased to cause the light emitting element 20 to emit light around the power supply voltage as seen from Expression 5. In other words, the emission intensity becomes less likely to be affected by the variation in the threshold voltage of the transistors as $Z_i$ increases.

Since $k/Z_3=2.74\times10^{-3}$ V and $k/Z_4=8.76\times10^{-3}$V are small values in Example 1, the second term on the left side of Expression 5 is $k/(Z_3(V_{gs3}-V_{th3}))=0.0005$ for the third transistor 33 and $k/(Z_4(V_{gs4}-V_{th4}))=0.001$ for the fourth transistor 34, and is thus less than approximately 0.01 (1%). As a result, the current (emission intensity) during the emission of the light emitting element 20 was little affected by the threshold voltages of the transistors.

In other words, the variation in the threshold voltage of the transistors affecting the emission intensity of the light emitting element 20 can be eliminated by setting a value of $k/(Z_i(V_{gsi}-V_{thi}))$ to be less than approximately 0.01 (1%). Note that, the definition of k and $Z_i$ is according to Expressions 3 and 4. As a greater $V_{gsi}$ is preferred, it is assumed in Example 1 that the fifth potential (V5=0 V) lower than the second potential (V2) is set for the enable signal (active signal) in the active state.

In Example 1, the ON-resistance of the third transistor 33 is less than or equal to the ON-resistance of the fourth transistor 34. As described above, the ON-resistance of the third transistor 33 is preferably less than or equal to half of the ON-resistance of the fourth transistor 34. Therefore, the polarity and size (i.e., gate length and gate width) of the third transistor 33 and the fourth transistor 34, the drive condition (i.e., potential of the enable signal), and the like are determined to reduce the ON-resistance of the third transistor 33 to lower than or equal to half of the ON-resistance of the fourth transistor 34.

When the ON-resistance of the third transistor 33 is less than or equal to the ON-resistance of the fourth transistor 34, the electrical conductance of the third transistor 33 is increased to greater than the electrical conductance of the fourth transistor 34. Then, when the ON-resistance of the third transistor 33 is less than or equal to half of the ON-resistance of the fourth transistor 34, the electrical conductance of the third transistor 33 can be increased to twice or higher than the electrical conductance of the fourth transistor 34. As a result, the risk that the image signal stored in the memory circuit 60 may be rewritten during the emission of the light emitting element 20 can be reduced. This is described below.

A state is considered where the fourth transistor 34 is switched from the OFF-state to the ON-state to cause emission of the light emitting element 20 while the potential of the output terminal 27 of the memory circuit 60 (second inverter 62) is Low. Upon this, if the on resistor of the third transistor 33 is greater than the ON-resistance of the fourth transistor 34 and the ON-resistance of the light emitting element 20 is relatively small, then the potential of the output terminal 27 (drain potential of the third transistor 33) may increase and exceed a logical inversion potential of the second inverter 62.

On the other hand, the ON-resistance of the third transistor 33 is less than or equal to the ON-resistance of the fourth transistor 34 in Example 1. Thus, even when the ON-resistance of the light emitting element 20 is assumed to be zero, the potential of the output terminal 27 is not increased up to a half of a power supply potential (the logical inversion potential of an inverter is usually almost equal to half of power supply potential) (the light emitting element 20 is actually present, and thus the potential of the output terminal 27 can be substantially prevented from reaching half of the power supply potential). Furthermore, as long as the ON-resistance of the third transistor 33 is less than or equal to half of the ON-resistance of the fourth transistor 34, the potential of the output terminal 27 is not increased up to half of the power supply potential even when the ON-resistance of the light emitting element 20 is assumed to be zero. As a result, the potential of the output terminal 27 can be prevented from exceeding the logical inversion potential of the first inverter 61 due to the emission of the light emitting element 20 (stored information can be prevented from being rewritten due to the light emission). Therefore, the risk that an image signal stored in the memory circuit 60 is rewritten during emission of the light emitting element 20 may be substantially eliminated by setting the ON-resistance of the third transistor 33 to be less than or equal to the ON-resistance of the fourth transistor 34 as in Example 1.

Note that, the gate length $L_1$ of the first transistor 31 is preferably substantially identical to the gate length of a transistor (for example, the third transistor 33) in the memory circuit 60. The reason is that the maximum value of the source-drain voltage of the first transistor 31 is the amplitude (V2−V1) of an image signal and is the same as the source-drain voltage of the transistor in the memory circuit 60. Further, the gate width $W_1$ of the first transistor 31 is preferably greater than the gate width of a transistor (for example, the third transistor 33) in the memory circuit 60. This is to allow an image signal to pass through the first transistor 31 at a high speed. In Example 1, $W_1$=1.25 micrometers (μm) and $L_1$=0.5 micrometer (μm).

The gate length $L_2$ of the second transistor 32 may be substantially identical to the gate length of a transistor (for example, the third transistor 33) in the memory circuit 60. The reason is that the maximum value of the source-drain voltage of the second transistor 32 is substantially the amplitude (V2−V1) of an image signal. Further, the gate width $W_2$ of the second transistor 32 may be smaller than the gate width of a transistor (for example, the third transistor 33) in the memory circuit 60. The reason is that a great amount of current does not need to be caused to flow in order to equalize potentials of the input terminal 25 and the output terminal 27 of the second transistor 32. In Example 1, $W_2$=0.5 micrometer (μm) and $L_2$=0.5 micrometer (μm).

Method for Driving Pixel Circuit

Figure 9:
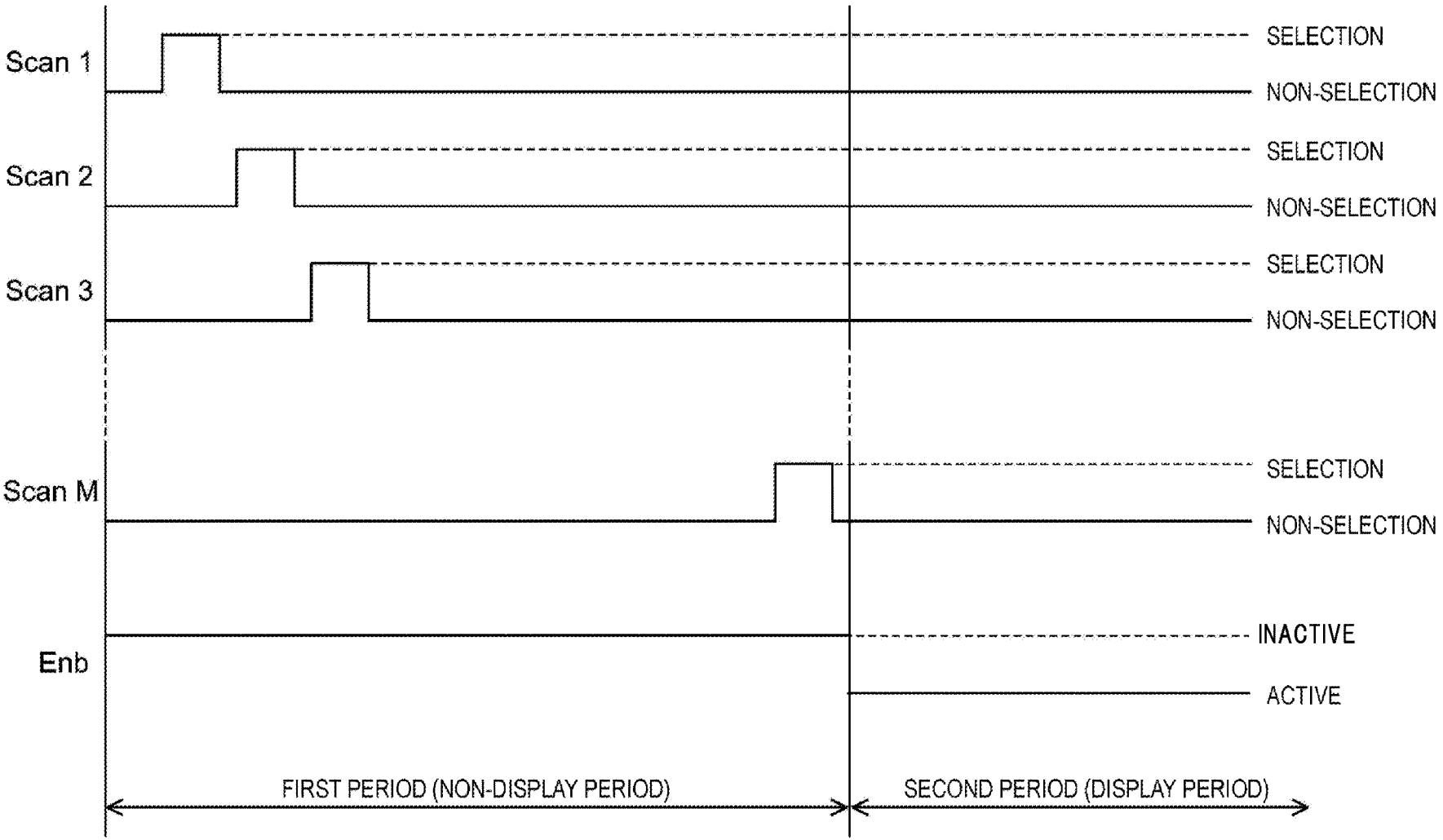
FIG. 9 shows a diagram illustrating a method for driving a pixel circuit according to the present exemplary embodiment.

Next, a method for driving a pixel circuit in the electro-optical device 10 according to the present exemplary embodiment will be described with reference to FIG. 9. FIG. 9 is a diagram illustrating a method for driving a pixel circuit according to the present exemplary embodiment. In FIG. 9, the horizontal axis is a time axis and includes a first period (non-display period) and a second period (display period). The first period corresponds to P1 (P1-1 to P1-6) illustrated in FIG. 7. The second period corresponds to P2 (P2-1 to P2-6) illustrated in FIG. 7.

In the vertical axis in FIG. 9, Scan 1 to Scan M represent scan signals supplied to the respective scan lines 42 from the first row to the M-th row of the M scan lines 42 (see FIG. 5). The scan signal includes a scan signal (selection signal) in a selection state and a scan signal (non-selection signal) in a non-selection state. Enb represents an enable signal supplied to the enable line 44 (see FIG. 5). The enable signal includes an enable signal in an active state (active signal) and an enable signal in an inactive signal (inactive signal).

As described with reference to FIG. 7, one field (F) during which a single image is displayed is divided into a plurality of subfields (SFs), and each of the subfields (SFs) includes the first period (non-display period) and the second period (display period) starting after the first period ends. The first period (non-display period) is a signal-writing period during which an image signal is written to the memory circuit 60 (see FIG. 8) in each of the pixel circuits 41 (see FIG. 5) located in the display region E. The second period (display period) is a period during which the light emitting element 20 (see FIG. 8) can emit light in each of the pixel circuits 41 located in the display region E.

As illustrated in FIG. 9, in the electro-optical device 10 according to the present exemplary embodiment, an inactive signal is supplied as the enable signal to all of the enable lines 44 during the first period (non-display period). When the inactive signal is supplied to the enable lines 44, the fourth transistors 34 (see FIG. 8) are placed into the OFF-state, such that the light emitting elements 20 in all of the pixel circuits 41 located in the display region E are placed into a non-emission state.

During the first period, a selection signal is supplied as the scan signal to any of the scan lines 42 in each of the subfields (SFs). When the selection signal is supplied to the scan line 42, the first transistor 31 (see FIG. 8) is placed into the ON-state and the second transistor 32 (see FIG. 8) is placed into the OFF-state in the selected pixel circuit 41. In this way, an image signal is written to the memory circuit 60 from the data line 43 (see FIG. 8) in the selected pixel circuit 41.

When the non-selection signal is supplied to the scan line 42 after the image signal is written to the memory circuit 60, the first transistor 31 is placed into the OFF-state and the second transistor 32 is placed into the ON-state in the pixel circuit 41 shifted from the selection to the non-selection. In this way, the image signal written to the memory circuit 60 is maintained.

During the second period (display period), an active signal is supplied as the enable signal to all of the enable lines 44. When the active signal is supplied to the enable lines 44, the fourth transistors 34 are placed into the ON-state to allow emission of the light emitting elements 20 in all of the pixel circuits 41 located in the display region E. During the second period, the non-selection signal for placing the first transistor 31 into the OFF-state and the second transistors 32 into the ON-state is supplied as the scan signal to all the scan lines 42. In this way, an image signal written in the subfield (SF) is maintained in the memory circuit 60 of each of the pixel circuits 41.

As described above, the first period (non-display period) and the second period (display period) can be controlled independently in the present exemplary embodiment, such that grey-scale display by digital time division driving can be achieved. As a result, the second period can be set to be shorter than the first period, such that display with higher grey-scale can be achieved.

Furthermore, an enable signal supplied to the enable line 44 can be shared among the plurality of pixel circuits 41, such that driving of the electro-optic device 10 can be facilitated. Specifically, for digital driving without the first period, highly complicated driving is required to make the light emission period shorter than one vertical period within which selection of each of the plurality of scan lines 42 is completed. In contrast, an enable signal supplied to the enable line 44 is shared among the plurality of pixel circuits 41 in the present exemplary embodiment, such that the electro-optical device 10 can be easily driven by simply setting the second period to be short even when some subfields (SFs) have a light emission period shorter than one vertical period in which selection of all the scan lines 42 is completed.

As described above, the configuration of the pixel circuit 41 according to the Example 1 can achieve an electro-optical device 10 that can display a high-resolution, multi-grey-scale, and high-quality image at low power consumption while operating at a higher speed and achieving a brighter display.

Hereinafter, modification examples (modification examples 1 to 6) of the pixel circuit of Example 1 will be described with reference to FIG. 8. In the following description of the modification examples, only differences between Example 1 or the above-described modification example and the modification examples below will be described.

Modification Example 1

While the cathode 23 of the light emitting element 20 in Example 1 is electrically connected to the output terminal 27 of the second inverter 62, the cathode 23 of the light emitting element 20 may be electrically connected to the output terminal 26 of the first inverter 61 (=the input terminal 28 of the second inverter 62). In such a configuration, the sixth transistor 36 also functions as a drive transistor for the light emitting element 20. In other words, when the sixth transistor 36 is placed into the ON-state while the fourth transistor 34 is in the ON-state, electrical communication is established through the path leading from the second potential line (high potential line 47), through the fourth transistor 34, the light emitting element 20 and the sixth transistor 36, and to the first potential line (low potential line 46) to cause emission of the light emitting element 20.

Modification Example 2

While the first transistor 31 is the N-type and the second transistor 32 is the P-type in Example 1, the first transistor 31 (namely, a first transistor 31A in Example 2 described later) may be the P-type, and the second transistor 32 (namely, a second transistor 32A in Example 2 described later) may be the N-type. In this case, the first potential (V1) is a high potential (V1=VDD=5.0 V as one example), and the second potential (V2) is a low potential (V2=VSS=0 V as one example).

Since the first transistor 31A is the P-type, the fourth potential (V4) as the potential of the selection signal is a low potential set to be lower than or equal to the second potential (V2) and is preferably the second potential (V2) (that is, V4=V2=0 V). In this way, there is always a state where the absolute value of a gate-source voltage of the first transistor 31A exceeds the absolute value of the threshold voltage $V_{th1}$ ($V_{th1}$=−0.36 V as one example) of the first transistor 31A, such that an image signal stored in the memory circuit 60 can be rewritten by a new image signal by the selection signal through the first transistor 31A.

On the other hand, since the second transistor 32A is the N-type, the third potential (V3) as the potential of the non-selection signal is set to $V3>V1+V_{th2}$ and is preferably such that V3=7.0 V, assuming that the threshold voltage of the second transistor 32A is $V_{th2}$ ($V_{th2}$=0.36 V as one example). When $V3>V1+V_{th2}$, the gate-source voltage of the second transistor 32A is greater than the threshold voltage $V_{th2}$ of the second transistor 32A and the second transistor 32A is placed into the ON-state. Then, when V3=7.0 V, the gate-source voltage of the second transistor 32A is sufficiently greater than the threshold voltage $V_{th2}$ of the second transistor 32A, such that the second transistor 32A can be placed into the ON-state reliably by the non-selection signal. In this way, the image signal written to the memory circuit 60 can be maintained in a stable state.

Since the fourth transistor 34 is the P-type, the fifth potential (V5) of the active signal is set to be as lower as possible than the first potential (V1) as the source potential of the fourth transistor 34 and is preferably the second potential (V2) (that is, V5=V2=0 V). The sixth potential (V6) of the inactive signal is set to be greater than or equal to the first potential (V1) and can be the first potential (V1).

Herein, while the sixth potential (V6) of the inactive signal may be the third potential (V3), no particular effect is obtained even when the potential of the inactive signal for placing the fourth transistor 34 into the OFF-state is set to be higher than the first potential (V1). In other words, even when the third potential (V3) is introduced as a signal of the non-selection signal for placing the second transistor 32A of the N-type into the ON-state, using the third potential (V3) as the potential of the active signal for placing the fourth transistor 34 of the P-type into the ON-state cannot contribute to a reduction in the ON-resistance of the fourth transistor 34 in the ON-state.

As with the pixel circuit 41 according to Example 1, when the second transistor 32 and the fourth transistor 34 are both the P-type, the ON-resistance of the fourth transistor 34 in the ON-state can be reduced by using, as a potential of the active signal, the third potential (V3) introduced as a signal of the non-selection signal. In other words, the second transistor 32 and the fourth transistor 34 may be the same conductive type (both may be the N-type or the P-type).

Modification Example 3

Modification Example 3 may have a configuration obtained by combining the configurations of Modification Example 1 and Modification Example 2. In other words, the first transistor 31A of the P-type and the second transistor 32A of the N-type may be provided, and the cathode 23 of the light emitting element 20 may be electrically connected to the output terminal 26 of the first inverter 61 (=the input terminal 28 of the second inverter 62).

Modification Example 4

In the configuration of Example 1, the scan line 42 may be designated as a first scan line and a second scan line separate from the scan line 42 may be provided to electrically connect to the gate of the second transistor 32. In such a configuration, a scan signal (selection signal and non-selection signal) is individually supplied to the first transistor 31 and the second transistor 32, such that the first transistor 31 and the second transistor 32 may be the same conductive type (both the N-type or the P-type).

Modification Example 5

In the configuration of Example 1, the fourth potential (V4) of the selection signal as the high potential may be such that $V4>V2+V_{th1}$, whereas the third potential (V3) of the non-selection signal as the low potential may be such that $V3<V1+V_{th2}$. As one example, when the first potential (V1) as the low potential is V1=1.0 V and the second potential (V2) as the high potential is V2=6.0 V, the third potential (V3) may be V3=0V and the fourth potential (V4) may be V4=7.0 V.

As described above, by introducing the third potential (V3) and the fourth potential (V4) as potentials of the scan signal (selection signal and non-selection signal) in addition to the first potential (V1) and the second potential (V2) for operating the memory circuit 60, the absolute values of the gate-source voltage of the first transistor 31 in the selection state and the gate-source voltage of the second transistor 32 in the non-selection state can be further increased. In this way, the first transistor 31 can be placed into the ON-state reliably by the selection signal, and the second transistor 32 can be placed into the ON-state reliably by the non-selection signal. Also, in this case, the fifth potential (V5) of the active signal as the low potential may be the third potential (V3), and the sixth potential (V&) of the inactive signal as the high potential may be the fourth potential (V4).

Modification Example 6

In the configuration of Modification Example 2, the fourth potential (V4) of the selection signal as the low potential may be such that $V4<V2+V_{th1}$, and the third potential (V3) of the non-selection signal as the high potential may be such that $V3>V1+V_{th2}$. As one example, when the first potential (V1) as the high potential is V1=6.0 V and the second potential (V2) as the low potential is V2=1.0 V, the third potential (V3) may be V3=7.0 V and the fourth potential (V4) may be V4=0 V. Also in such a setting, the first transistor 31A can be placed into the ON-state reliably by the selection signal, and the second transistor 32A can be placed into the ON-state reliably by the non-selection signal.

Example 2

Configuration of Pixel Circuit

Figure 10:
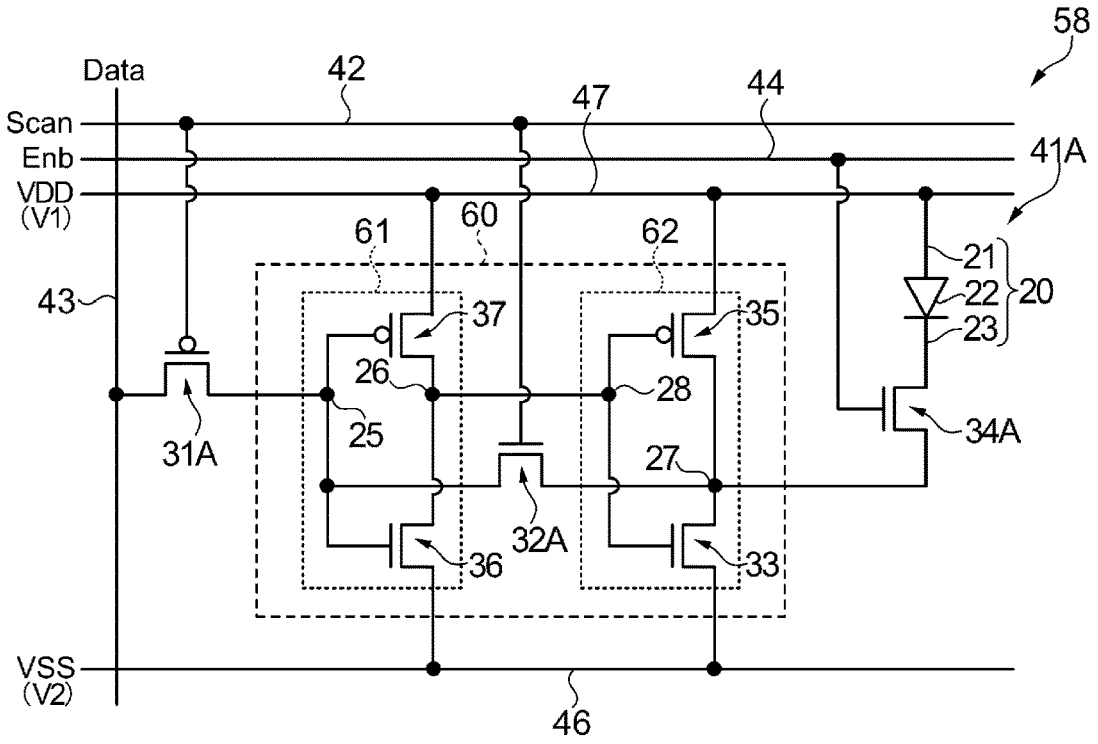
FIG. 10 shows a diagram illustrating a configuration of a pixel circuit according to Example 2.

Next, a configuration of a pixel circuit according to Example 2 will be described. FIG. 10 shows a diagram illustrating a configuration of the pixel circuit according to Example 2. In the following description of Example 2, only differences between Example 1 and Example 2 will be described: throughout the drawings, like numerals are assigned to the same components as those in Example 1 and their description will be omitted.

As illustrated in FIG. 10, a pixel circuit 41A according to Example 2 includes the light emitting element 20, the memory circuit 60, a first P-type transistor 31A, and a fourth N-type transistor 34A. A second N-type transistor 32A is disposed between the output terminal 27 of the second inverter 62 and the input terminal 25 of the first inverter 61 in the memory circuit 60. In other words, the pixel circuit 41A according to Example 2 is different from the pixel circuit 41 according to Example 1 in that the first transistor 31A is the P-type instead of the N-type, the second transistor 32A is the N-type instead of the P-type, and the fourth transistor 34A is the N-type instead of the P-type.

A high potential and a low potential in the pixel circuit 41 according to Example 1 are switched in the pixel circuit 41A according to Example 2. Specifically, the first potential (V1) is a high potential VDD (V1=VDD=5.0 V as one example), and the second potential (V2) is a low potential VSS (V2=VSS=0 V as one example). The first potential (V1) is supplied from the high potential line 47 as a first potential line. The second potential (V2) is supplied from the low potential line 46 as a second potential line.

The source of the sixth transistor 36 is electrically connected to the second potential line (low potential line 46), and the source of the seventh transistor 37 is electrically connected to the first potential line (high potential line 47) in the first inverter 61 constituting the memory circuit 60. The source of the third transistor 33 is electrically connected to the second potential line (low potential line 46), and the source of the fifth transistor 35 is electrically connected to the first potential line (high potential line 47) in the second inverter 62.

The first transistor 31A is disposed between the input terminal 25 of the first inverter 61 of the memory circuit 60 and the data line 43. The second transistor 32A is disposed between the output terminal 27 of the second inverter 62 and an input terminal 25 of the first inverter 61 in the memory circuit 60. The first P-type transistor 31A and the second N-type transistor 32A are different conductive types from each other and operate in a complementary manner to each other.

The fourth transistor 34A is disposed in series with the light emitting element 20 between the output terminal 27 of the second inverter 62 (drain of the third transistor 33 and the fifth transistor 35) and the first potential line (high potential line 47). The anode 21 of the light emitting element 20 is electrically connected to the first potential line (high potential line 47). The cathode 23 of the light emitting element 20 is electrically connected to the drain of the fourth transistor 34A. The source of the fourth transistor 34A is electrically connected to the output terminal 27 of the second inverter 62. In other words, the fourth N-type transistor 34A is disposed on the low potential side with respect to the light emitting element 20 and the third N-type transistor 33 is disposed on the low potential side with respect to the fourth transistor 34A.

When the third transistor 33 is placed into the ON-state while the fourth transistor 34A is in the ON-state, electrical communication is established through the path leading from the first potential line (high potential line 47), through the light emitting element 20, the fourth transistor 34A and the third transistor 33, and to the second potential line (low potential line 46) to cause emission of the light emitting element 20.

In the pixel circuit 41A according to Example 2, the third transistor 33 of the second inverter 62 is disposed between the fourth transistor 34A and the second potential line (low potential line 46). Thus, when the fourth transistor 34A and the third transistor 33 are placed into the ON-state, the source potential of the fourth transistor 34A becomes slightly higher than the second potential (V2). However, with the source potential of the third transistor 33 fixed at the second potential (V2) to allow linear operation of the third transistor 33, the source potential of the fourth transistor 34A can be substantially equal to the second potential (V2).

Potential of Each Signal

Next, a potential of each signal in the pixel circuit 41A according to Example 2 will be described. In Example 2, the drive circuit 51 and the memory circuit 60 are operated by a power supply supplied with a first potential (V1=VDD=5.0 V as one example) and a second potential (V2=VSS=0 V as one example). The image signal supplied from the data line 43 to the memory circuit 60 is either the first potential (V1) or the second potential (V2).

For the scan signal (selection signal and non-selection signal), since the first transistor 31A is the P-type and the second transistor 32A is the N-type, the selection signal for placing the first transistor 31A into the ON-state and the second transistor 32A into the OFF-state is a low potential. Further, the non-selection signal for placing the first transistor 31A into the OFF-state and the second transistor 32A into the ON-state is a high potential. The potential of the selection signal is designated as a fourth potential (V4), and the potential of the non-selection signal is designated as a third potential (V3).

The fourth potential (V4) of the selection signal may be set to be lower than or equal to the second potential (V2) and is preferably the second potential (V2) (that is, V4=V2=0 V). In this way, the first transistor 31A can be placed into the ON-state and the second transistor 32A into the OFF-state reliably by the selection signal, such that an image signal can be written (or rewritten) to the memory circuit 60 in a quick and reliable manner.

The third potential (V3) of the non-selection signal is set to $V3>V1+V_{th2}$ and is preferably V3=7.0 V, assuming that the threshold voltage of the second transistor 32A is $V_{th2}$ ($V_{th2}$=0.36 V as one example). Since the second transistor 32A is the N-type, when $V3>V1+V_{th2}$, the gate-source voltage of the second transistor 32A becomes greater than the threshold voltage $V_{th2}$ of the second transistor 32A and the second transistor 32A is placed into the ON-state.

Then, when the third potential (V3) is higher than the first potential (V1) with V3=7.0 V, the gate-source voltage of the second transistor 32A becomes sufficiently greater than the threshold voltage $V_{th2}$ of the second transistor 32A, such that the second transistor 32A can be placed into the ON-state reliably by the non-selection signal and the first transistor 31A can be placed into the OFF-state. In this way, the image signal stored in the memory circuit 60 can be maintained in a stable state.

For the enable signal (active signal and inactive signal), since the fourth transistor 34A is the N-type, the active signal for placing the fourth transistor 34A into the ON-state is a high potential and the inactive signal for placing the fourth transistor 34A into the OFF-state is a low potential. The potential of the active signal is designated as a fifth potential (V5) and the potential of the inactive signal is designated as a sixth potential (V6).

The fifth potential (V5) of the active signal is set to be as higher as possible than the second potential (V2) as the source potential of the fourth transistor 34A and is preferably the third potential (V3) (that is, V5=V3=7.0 V). In this way, the fourth transistor 34A can be placed into the ON-state reliably by the active signal, and the ON-resistance in the ON-state can also be reduced. Further, the sixth potential (V6) of the inactive signal is set to be lower than or equal to the second potential (V2) and is preferably the second potential (V2) (that is, V6=V2=0 V). In this way, the fourth transistor 34A can be placed into the OFF-state reliably by the inactive signal.

Characteristics of Transistor

Also in the pixel circuit 41A according to Example 2, the ON-resistance of the fourth transistor 34A disposed in series with the light emitting element 20 is preferably sufficiently lower than the ON-resistance of the light emitting element 20. In this way, when the light emitting element 20 emits light, the fourth transistor 34A can be linearly operated.

The ON-resistance of the third transistor 33 is preferably less than or equal to the ON-resistance of the fourth transistor 34A. If the ON-resistance of the third transistor 33 is greater than the ON-resistance of the fourth transistor 34A, then the potential of the output terminal 27 of the second inverter 62 is increased from Low, which is close to VSS supplied from the second potential line (low potential line 46), when the third transistor 33 is placed into the ON-state. Since the source of the fourth transistor 34A is electrically connected to the output terminal 27, the potential of the output terminal 27 is the potential of the source of the fourth transistor 34A. Accordingly, when the potential of the output terminal 27 increases from Low, the gate-source voltage of the fourth transistor 34A will decrease and the ON-resistance of the fourth transistor 34A will increase. As a result, the fourth transistor 34A may not operate linearly. In other words, the variation in the threshold voltage of the fourth transistor 34A may cause variation in the emission intensity of the light emitting element 20.

On the other hand, when the ON-resistance of the third transistor 33 is smaller than the ON-resistance of the fourth transistor 34A as in the pixel circuit 41A according to Example 2, the source-drain voltage ($V_{ds3}$) of the third transistor 33 becomes smaller than the source-drain voltage of the fourth transistor 34A. In brief, the source potential ($V2+V_{ds3}$) of the fourth transistor 34A can have a small value around V2, such that the fourth transistor 34A is easily linearly operated. As a result, the influence that the variation in the threshold voltage of the third transistor 33 or the fourth transistor 34 has on the light emission intensity of the light emitting element 20 can be eliminated. Therefore, with the configuration of the pixel circuit 41 according to Example 2, an electro-optic device 10 that can display a high-quality image without any display error can also be achieved.

Hereinafter, modification examples (modification examples 7 to 12) of the pixel circuit of Example 2 will be described with reference to FIG. 10. In the following description of the modification examples, only differences between Example 2 or the above-described modification examples and the modification examples below will be described.

Modification Example 7

While the source of the fourth transistor 34A in Example 2 is electrically connected to the output terminal 27 of the second inverter 62, the source of the fourth transistor 34A may be electrically connected to the output terminal 26 of the first inverter 61 (=the input terminal 28 of the second inverter 62). In such a configuration, the sixth transistor 36 also functions as a drive transistor for the light emitting element 20.

Modification Example 8

While the first transistor 31A is the P-type and the second transistor 32A is the N-type in Example 2, the first transistor 31A (namely, the first transistor 31 in Example 1) may be the N-type, and the second transistor 32 (namely, the second transistor 32 in Example 1) may be the P-type. In this case, the first potential (V1) is a low potential (V1=VSS=2.0 V as one example), and the second potential (V2) is a high potential (V2=VDD=7.0 V as one example).

Since the first transistor 31 is the N-type, the fourth potential (V4) as the potential of the selection signal is a high potential set to be greater than or equal to the second potential (V2) and is preferably the second potential (V2) (that is, V4=V2=7.0 V). In this way, the first transistor 31 can be placed into the ON-state reliably by the selection signal.

On the other hand, since the second transistor 32 is the P-type, the third potential (V3) as the potential of the non-selection signal is set to $V3<V1+V_{th2}$ and is preferably such that V3=0 V, assuming that the threshold voltage of the second transistor 32 is $V_{th2}$ ($V_{th2}$=−0.36 V as one example). When $V3<V1+V_{th2}$, the absolute value of the gate-source voltage of the second transistor 32 is greater than the absolute value of the threshold voltage $V_{th2}$ of the second transistor 32 and the second transistor 32 is placed into the ON-state. Then, when V3=0 V, the absolute value of the gate-source voltage of the second transistor 32 is sufficiently greater than the absolute value of the threshold voltage $V_{th2}$ of the second transistor 32, such that the second transistor 32 can be placed into the ON-state reliably by the non-selection signal.

Since the fourth transistor 34A is the N-type, the fifth potential (V5) of the active signal is set to be as higher as possible than the first potential (V1) as the source potential of the fourth transistor 34A and is preferably the second potential (V2) (that is, V5=V2=7.0 V). The sixth potential (V6) of the inactive signal is set to be lower than or equal to the first potential (V1) and can be the first potential (V1). The sixth potential (V6) may be the third potential (V3).

Modification Example 9

Modification Example 9 may have a configuration obtained by combining the configurations of Modification Example 7 and Modification Example 8. In other words, the first transistor 31 of the N-type and the second transistor 32 of the P-type may be provided, and the cathode 23 of the light emitting element 20 may be electrically connected to the output terminal 26 of the first inverter 61 (=the input terminal 28 of the second inverter 62).

Modification Example 10

In the configuration of Example 2, the scan line 42 may be designated as a first scan line and a second scan line separate from the scan line 42 may be provided to electrically connect to the gate of the second transistor 32A. In such a configuration, a scan signal (selection signal and non-selection signal) is individually supplied to the first transistor 31A and the second transistor 32A, and the first transistor 31A and the second transistor 32A may be the same conductive type (both the N-type or the P-type).

Modification Example 11

In the configuration of Example 2, the fourth potential (V4) of the selection signal as the low potential may be such that $V4<V2+V_{th1}$, and the third potential (V3) of the non-selection signal as the high potential may be such that $V3>V1+V_{th2}$. As one example, when the first potential (V1) as the high potential is V1=6.0 V and the second potential (V2) as the low potential is V2=1.0 V, the fourth potential (V4) may be V4=0 V and the third potential (V3) may be V3=7.0 V. As described above, by introducing the third potential (V3) and the fourth potential (V4) as potentials of the scan signal (selection signal and non-selection signal) in addition to the first potential (V1) and the second potential (V2) operating the memory circuit 60, the first transistor 31A can be placed into the ON-state reliably by the selection signal and the second transistor 32A can be placed into the ON-state reliably by the non-selection signal.

Modification Example 12

In the configuration of Modification Example 8, the fourth potential (V4) of the selection signal as the high potential may be such that $V4>V2+V_{th1}$ and the third potential (V3) of the non-selection signal as the low potential may be such that $V3<V1+V_{th2}$. As one example, when the first potential (V1) as the low potential is V1=1.0 V and the second potential (V2) as the high potential is V2=6.0 V, the fourth potential (V4) may be V4=7.0 V and the third potential (V3) may be V3=0 V. Also in such a setting, the first transistor 31 can be placed into the ON-state reliably by the selection signal, and the second transistor 32 can be placed into the ON-state reliably by the non-selection signal.

Example 3

Configuration of Pixel Circuit

Figure 11:
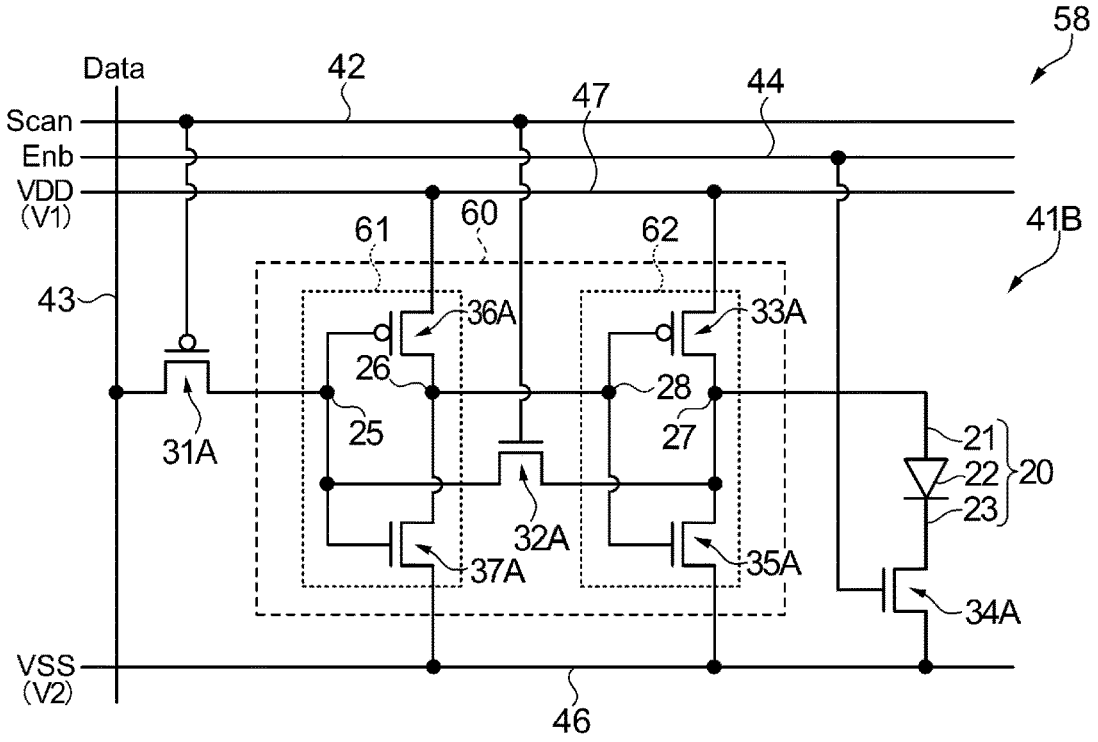
FIG. 11 shows a diagram illustrating a configuration of a pixel circuit according to Example 3.

Next, a configuration of a pixel circuit according to Example 3 will be described. FIG. 11 shows a diagram illustrating a configuration of the pixel circuit according to Example 3. In the following description of Example 3, only differences between Examples 1 and 2 and Example 3 will be described: throughout the drawings, like numerals are assigned to the same components as those in Examples 1, 2 and their description will be omitted.

As illustrated in FIG. 11, a pixel circuit 41B according to Example 3 includes the light emitting element 20, the memory circuit 60, a first P-type transistor 31A, and a fourth N-type transistor 34A. A second N-type transistor 32A is disposed between the output terminal 27 of the second inverter 62 and the input terminal 25 of the first inverter 61 in the memory circuit 60.

The pixel circuit 41B according to Example 3 is different from the pixel circuit 41A according to Example 2 in that the first inverter 61 includes a sixth N-type transistor 36A and a seventh N-type transistor 37A, and the second inverter 62 includes a third P-type transistor 33A and a fifth N-type transistor 35A.

The source of the sixth transistor 36A is electrically connected to the first potential line (high potential line 47), and the source of the seventh transistor 37A is electrically connected to the second potential line (low potential line 46) in the first inverter 61. The source of the third transistor 33A is electrically connected to the first potential line (high potential line 47), and the source of the fifth transistor 35A is electrically connected to the second potential line (low potential line 46) in the second inverter 62. The third transistor 33A functions as a drive transistor for the light emitting element 20.

In the pixel circuit 41B according to Example 3, the light emitting element 20 may be placed into an emission state when the potential of the output terminal 26 of the first inverter 61 (=the input terminal 28 of the second inverter 62) is Low, that is, when the potential of the output terminal 27 of the second inverter 62 is High. The light emitting element 20 in placed into a non-emission state when the potential of the output terminal 26 of the first inverter 61 (=the input terminal 28 of the second inverter 62) is High, that is, when the potential of the output terminal 27 of the second inverter 62 is Low.

Further, the pixel circuit 41B according to Example 3 is different from the pixel circuit 41A according to Example 2 in that the light emitting element 20 and the fourth transistor 34A are disposed in series between the output terminal 27 of the second inverter 62 and the second potential line (low potential line 46). Specifically, the anode 21 of the light emitting element 20 is electrically connected to the output terminal 27 of the second inverter 62 (drain of the third transistor 33A and the fifth transistor 35A). In the pixel circuit 41B according to Example 3, the anode 21 corresponds to a first terminal of the light emitting element 20.

The cathode 23 of the light emitting element 20 is connected to the drain of the fourth transistor 34A. The source of the fourth transistor 34A is electrically connected to the second potential line (low potential line 46). Therefore, the third P-type transistor 33A is disposed on the high potential side with respect to the light emitting element 20, and the fourth N-type transistor 34A is disposed on the low potential side with respect to the light emitting element 20.

In the pixel circuit 41B according to Example 3, when the third transistor 33A is placed into the ON-state while the fourth transistor 34A is in the ON-state, electrical communication is established through the path leading from the first potential line (high potential line 47), through the third transistor 33A, the light emitting element 20 and the fourth transistor 34A, and to the second potential line (low potential line 46) to cause emission of the light emitting element 20.

With the third P-type transistor 33A disposed on the high potential side with respect to the light emitting element 20 and the fourth N-type transistor 34A on the low potential side, the third transistor 33A and the fourth transistor 34A can be linearly operated when the light emitting element 20 emits light. Accordingly, any variation in the threshold voltage of the third transistor 33A and the fourth transistor 34A can be prevented from affecting display characteristics also in the configuration of the pixel circuit 41B according to Example 3.

The potential of each signal in the pixel circuit 41B according to Example 3 can be set to be identical to the potential of each signal in the pixel circuit 41A according to Example 2.

Hereinafter, modification examples (modification examples 13 to 18) of the pixel circuit of Example 3 will be described with reference to FIG. 11. In the following description of the modification examples, only differences between Example 3 or the above-described modification examples and the modification examples below will be described.

Modification Example 13

While the anode 21 of the light emitting element 20 is electrically connected to the output terminal 27 of the second inverter 62 in Example 3, the anode 21 of the light emitting element 20 may be electrically connected to the output terminal 26 of the first inverter 61 (=the input terminal 28 of the second inverter 62). In such a configuration, the sixth transistor 36A also functions as a drive transistor for the light emitting element 20.

Modification Example 14

While the first transistor 31A is the P-type and the second transistor 32A is the N-type in Example 3, the first transistor 31A (namely, the first transistor 31 in Example 1) may be the N-type, and the second transistor 32 (namely, the second transistor 32 in Example 1) may be the P-type.

Modification Example 15

Modification Example 15 may have a configuration obtained by combining the configurations of Modification Example 13 and Modification Example 14. In other words, the first transistor 31 of the N-type and the second transistor 32 of the P-type may be provided, and the anode 21 of the light emitting element 20 may be electrically connected to the output terminal 26 of the first inverter 61 (=the input terminal 28 of the second inverter 62).

Modification Example 16

In the configuration of Example 3, the scan line 42 may be designated as a first scan line and a second scan line separate from the scan line 42 may be provided to electrically connect to the gates of the second transistors 32 and 32A. In such a configuration, a scan signal (selection signal and non-selection signal) is individually supplied to the first transistor 31A and the second transistor 32A, and the first transistor 31A and the second transistor 32A may be the same conductive type (both the N-type or the P-type).

Modification Example 17

In the configuration of Example 3, the fourth potential (V4) of the selection signal as the low potential may be such that $V4<V2+V_{th1}$, and the third potential (V3) of the non-selection signal as the high potential may be such that $V3>V1+V_{th2}$. As one example, when the first potential (V1) as the high potential is V1=6.0 V and the second potential (V2) as the low potential is V2=1.0 V, the fourth potential (V4) may be V4=0 V and the third potential (V3) may be V3=7.0 V. As described above, by introducing the third potential (V3) and the fourth potential (V4) as potentials of the scan signal (selection signal and non-selection signal) in addition to the first potential (V1) and the second potential (V2) operating the memory circuit 60, the first transistor 31A can be placed into the ON-state reliably by the selection signal and the second transistor 32A can be placed into the ON-state reliably by the non-selection signal.

Modification Example 18

In the configuration of Modification Example 14, the fourth potential (V4) of the selection signal as the high potential may be such that $V4>V2+V_{th1}$ and the third potential (V3) of the non-selection signal being a low potential may be such that $V3<V1+V_{th2}$. As one example, when the first potential (V1) as the low potential is V1=1.0 V and the second potential (V2) as the high potential is V2=6.0 V, the fourth potential (V4) may be V4=7.0 V and the third potential (V3) may be V3=0 V. Also in such a setting, the first transistor 31 can be placed into the ON-state reliably by the selection signal, and the second transistor 32 can be placed into the ON-state reliably by the non-selection signal.

Example 4

Configuration of Pixel Circuit

Figure 12:
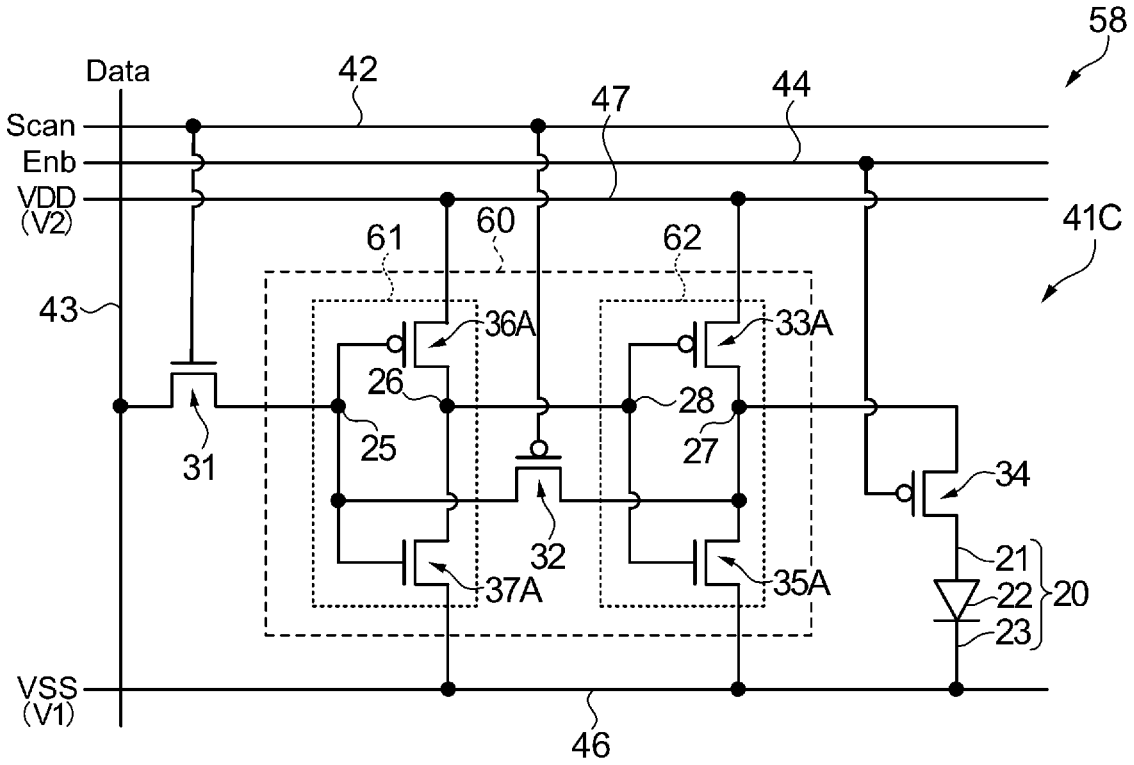
FIG. 12 shows a diagram illustrating a configuration of a pixel circuit according to Example 4.

Next, a configuration of a pixel circuit according to Example 4 will be described. FIG. 12 shows a diagram illustrating a configuration of the pixel circuit according to Example 4. In the following description of Example 4, only differences between Examples 1, 2, and 3 and Example 4 will be described: throughout the drawings, like numerals are assigned to the same components as those in Examples 1, 2, and 3 and their description will be omitted.

As illustrated in FIG. 12, a pixel circuit 41C according to Example 4 includes the light emitting element 20, the memory circuit 60, a first transistor N-type 31, and a fourth P-type transistor 34. A second P-type transistor 32 is disposed between the output terminal 27 of the second inverter 62 and the input terminal 25 of the first inverter 61 in the memory circuit 60. The pixel circuit 41C according to Example 4 is different from the pixel circuit 41B according to Example 3 in that the pixel circuit 41C includes the first transistor 31 of the N-type, the second transistor 32 of the P-type, and the fourth transistor 34 of the P-type.

In the pixel circuit 41C according to Example 4, the source of the fourth transistor 34 is electrically connected to the output terminal 27 of the second inverter 62 and the drain of the fourth transistor 34 is electrically connected to the anode 21 of the light emitting element 20. The cathode 23 of the light emitting element 20 is electrically connected to the second potential line (low potential line 46). In other words, the fourth P-type transistor 34 is disposed on the high potential side with respect to the light emitting element 20 and the third P-type transistor 33A is disposed on the high potential side with respect to the fourth transistor 34.

When the third transistor 33A is placed into the ON-state while the fourth transistor 34 is in the ON-state, electrical communication is established through the path leading from the second potential line (high potential line 47), through the third transistor 33A, the fourth transistor 34 and the light emitting element 20, and to the first potential line (low potential line 46) to cause emission of the light emitting element 20.

In the pixel circuit 41C according to Example 4, the third transistor 33A of the second inverter 62 is disposed between the fourth transistor 34 and the second potential line (high potential line 47). Thus, when the fourth transistor 34 and the third transistor 33A are placed into the ON-state, the source potential of the fourth transistor 34 becomes slightly lower than the second potential (V2). However, with the source potential of the third transistor 33A fixed at the second potential (V2) to allow linear operation of the third transistor 33A, the source potential of the fourth transistor 34A can be substantially equal to the second potential (V2).

The same effects as those of the pixel circuit 41B according to Example 3 can also be achieved by the configuration of the pixel circuit 41C according to Example 4.

Hereinafter, modification examples (modification examples 19 to 24) of the pixel circuit of Example 4 will be described with reference to FIG. 12. In the following description of the modification examples, only differences between Example 4 or the above-described modification examples and the modification examples below will be described.

Modification Example 19

While the source of the fourth transistor 34 is electrically connected to the output terminal 27 of the second inverter 62 in Example 4, the source of the fourth transistor 34 may be electrically connected to the output terminal 26 of the first inverter 61 (=the input terminal 28 of the second inverter 62). In such a configuration, the sixth transistor 36A also functions as a drive transistor for the light emitting element 20.

Modification Example 20

While the first transistor 31 is the N-type and the second transistor 32 is the P-type in Example 4, the first transistor 31 (namely, the first transistor 31A in Example 2) may be the P-type, and the second transistor 32 (namely, the second transistor 32A in Example 2) may be the N-type.

Modification Example 21

Modification Example 21 may have a configuration obtained by combining the configurations of Modification Example 19 and Modification Example 20. In other words, the first transistor 31A of the P-type and the second transistor 32A of the N-type may be provided, and the source of the fourth transistor 34 may be electrically connected to the output terminal 26 of the first inverter 61 (=the input terminal 28 of the second inverter 62).

Modification Example 22

In the configuration of Example 4, the scan line 42 may be designated as a first scan line and a second scan line separate from the scan line 42 may be provided to electrically connect the gate of the second transistor 32 to the second scan line. In such a configuration, a scan signal (selection signal and non-selection signal) is individually supplied to the first transistor 31 and the second transistor 32, and the first transistor 31 and the second transistor 32 may be the same conductive type (both the N-type or the P-type).

Modification Example 23

In the configuration of Example 4, the fourth potential (V4) of the selection signal as the high potential may be such that $V4>V2+V_{th1}$ and the third potential (V3) of the non-selection signal as the low potential may be such that $V3<V1+V_{th2}$. As one example, when the first potential (V1) as the low potential is V1=1.0 V and the second potential (V2) the high potential is V2=6.0 V, the fourth potential (V4) may be V4=7.0 V and the third potential (V3) may be V3=0 V. As described above, by introducing the third potential (V3) and the fourth potential (V4) as potentials of the scan signal (selection signal and non-selection signal) in addition to the first potential (V1) and the second potential (V2) operating the memory circuit 60, the first transistor 31 can be placed into the ON-state reliably by the selection signal and the second transistor 32 can be placed into the ON-state reliably by the non-selection signal.

Modification Example 24

In the configuration of Modification Example 20, the fourth potential (V4) of the selection signal as the low potential may be such that $V4<V2+V_{th1}$, and the third potential (V3) of the non-selection signal as the high potential may be such that $V3>V1+V_{th2}$. As one example, when the first potential (V1) as the high potential is V1=6.0 V and the second potential (V2) as the low potential is V2=1.0 V, the fourth potential (V4) may be V4=0 V and the third potential (V3) may be V3=7.0 V. Also in such a setting, the first transistor 31A can be placed into the ON-state reliably by the selection signal, and the second transistor 32A can be placed into the ON-state reliably by the non-selection signal.

The above-described exemplary embodiments (examples and modification examples) merely illustrate one aspect of the present invention, and modification and application may further be possible within the scope of the present invention. Hereinafter, modification examples other than the above-described modification examples will be described.

Modification Example 25

In the configuration of each of Examples 1, 2, 3, and 4 and each of the modification examples, the third potential (V3) and the fifth potential (V5) may be identical to the first potential (V1), and the fourth potential (V4) and the sixth potential (V6) may be identical to the second potential (V2). In other words, it may be such that V3=V5=V1 and V4=V6=V2. In this way, the first potential (V1) and the second potential (V2) for operating the memory circuit 60 may be used as the potentials of the scan signal and the enable signal, such that there is no need to increase the number of power supplies. Also in such a setting, each transistor can be placed into the ON-state or the OFF-state by each signal.

Modification Example 26

The configuration of each of Examples 1, 2, 3, and 4 and each of the modification examples may not include the fourth transistor 34 (or 34A). However, this requires that the cathode 23 of the light emitting element 20 be electrically connected to the output terminal 27 of the second inverter 62. When the third transistor 33 is placed into the ON-state in the configuration that does not include the fourth transistor 34 (or 34A), electrical communication is established through the path leading from the high potential line 47, through the light emitting element 20 and the third transistor 33, and to the low potential line 46 to cause emission of the light emitting element 20. In this configuration, the fourth transistor 34 (or 34A) and the enable line 44 may be omitted.

Modification Example 27

While the memory circuit 60 includes the two inverters 61 and 62 in the configuration of each of Examples 1, 2, 3, and 4 and each of the modification examples, the memory circuit 60 may include two or more even-numbered inverters.

Modification Example 28

While in the exemplary embodiments described above, an organic EL device in which the light emitting elements 20 each including an organic EL element are arranged in 720 rows×3840 (1280×3) columns on an element substrate 11 formed of a single-crystal semiconductor substrate (a single-crystal silicon wafer) is described as an exemplary electro-optic device, the electro-optic device of the present disclosure is not limited to such an aspect. For example, the electro-optical device may include a thin film transistor (TFT) as each transistor formed on the element substrate 11 formed of a glass substrate, or the electro-optical device may include a TFT on a flexible substrate formed of polyimide and the like. Further, the electro-optical device may be a micro LED display in which fine LED elements are aligned as light emitting elements in high density or a quantum dots display in which a nanosized semiconductor crystal material is used for the light emitting element. Furthermore, a quantum dot that converts incident light into light having a different wavelength may be used as a color filter.

Modification Example 29

While the electronic apparatus has been described in the above-described exemplary embodiments by taking, as an example, the see-through head-mounted display 100 incorporating the electro-optical device 10, the electro-optical device 10 of the present invention is also applicable to other electronic apparatuses including a closed-type head-mounted display. Other types of electronic apparatus include, for example, projectors, rear-projection televisions, direct-viewing televisions, cell phones, portable audio devices, personal computers, video camera monitors, automotive navigation devices, head-up displays, pagers, electronic organizers, calculators, wearable devices such as wristwatches, handheld displays, word processors, workstations, video phones, POS terminals, digital still cameras, signage displays, and the like.

The entire disclosure of Japanese Patent Application No. 2017-228728, filed Nov. 29, 2017 is expressly incorporated by reference herein.

What is claimed is:

1. An electro-optical device, comprising:

a scan line;

a data line;

a pixel circuit located at a position corresponding to an intersection of the scan line and the data line;

a first potential line that supplies a first potential; and a second potential line that supplies a second potential different from the first potential, wherein:

the pixel circuit includes a light emitting element, a first transistor, and a memory circuit that includes a first inverter, a second inverter, and a second transistor, the memory circuit is disposed between the first potential line and the second potential line, the first transistor is disposed between an input of the first inverter and the data line, the second transistor is disposed between an output of the second inverter and the input of the first inverter, an output of the first inverter is electrically connected to an input of the second inverter, when the first transistor is in an ON-state, the second transistor is in an OFF-state, and the light emitting element is disposed between the output of the second inverter and the second potential line.

2. The electro-optical device according to claim 1, wherein the first transistor and the second transistor operate in a complementary manner to each other.

3. The electro-optical device according to claim 2, wherein the first transistor is a first conductive type and the second transistor is a second conductive type different from the first conductive type, and a gate of the first transistor and a gate of the second transistor are electrically connected to the scan line.

4. An electronic apparatus comprising the electro-optical device according to claim 1.

5. An electro-optical device, comprising:

a scan line;

a data line;

a pixel circuit located at a position corresponding to an intersection of the scan line and the data line;

a first potential line that supplies a first potential; and a second potential line that supplies a second potential different from the first potential, wherein:

the pixel circuit includes a light emitting element, a first transistor, and a memory circuit that includes a first inverter, a second inverter, and a second transistor, the memory circuit is disposed between the first potential line and the second potential line, the first transistor is disposed between an input of the first inverter and the data line, the second transistor is disposed between an output of the second inverter and the input of the first inverter, an output of the first inverter is electrically connected to an input of the second inverter, when the first transistor is in an ON-state, the second transistor is in an OFF-state, the second inverter includes a third transistor, and a source of the third transistor is electrically connected to the first potential line, and a drain of the third transistor is electrically connected to a first terminal of the light emitting element.

6. The electro-optical device according to claim 5, wherein the first transistor and the second transistor operate in a complementary manner to each other.

7. The electro-optical device according to claim 6, wherein the first transistor is a first conductive type and the second transistor is a second conductive type different from the first conductive type, and a gate of the first transistor and a gate of the second transistor are electrically connected to the scan line.

8. An electronic apparatus comprising the electro-optical device according to claim 5.

9. An electro-optical device, comprising:

a scan line;

a data line;

a pixel circuit located at a position corresponding to an intersection of the scan line and the data line;

a first potential line that supplies a first potential; and a second potential line that supplies a second potential different from the first potential, wherein:

the pixel circuit includes a light emitting element, a first transistor, and a memory circuit that includes a first inverter, a second inverter, and a second transistor, the memory circuit is disposed between the first potential line and the second potential line, the first transistor is disposed between an input of the first inverter and the data line, the second transistor is disposed between an output of the second inverter and the input of the first inverter, an output of the first inverter is electrically connected to an input of the second inverter, when the first transistor is in an ON-state, the second transistor is in an OFF-state, the pixel circuit further includes a fourth transistor, and the fourth transistor is disposed in series with the light emitting element between the output of the second inverter and the second potential line.

10. The electro-optical device according to claim 9, wherein the light emitting element and the fourth transistor are disposed in series in this order between the output of the second inverter and the second potential line.

11. The electro-optical device according to claim 9, wherein the first transistor and the second transistor operate in a complementary manner to each other.

12. The electro-optical device according to claim 11, wherein the first transistor is a first conductive type and the second transistor is a second conductive type different from the first conductive type, and a gate of the first transistor and a gate of the second transistor are electrically connected to the scan line.

13. An electronic apparatus comprising the electro-optical device according to claim 9.

* * * * *